US007285153B2

(12) United States Patent
Bruun et al.

(10) Patent No.: US 7,285,153 B2
(45) Date of Patent: Oct. 23, 2007

(54) METHOD AND EQUIPMENT FOR FEEDING TWO GASES INTO AND OUT OF A MULTI-CHANNEL MONOLITHIC STRUCTURE

(75) Inventors: Tor Bruun, Porsgrunn (NO); Bjørnar Werswick, Langesund (NO); Kåre Kristiansen, Skien (NO); Leif Grønstad, Sannidal (NO)

(73) Assignee: Norsk Hydro ASA, Oslo (NO)

( * ) Notice: Subject to any disclaimer, the term of this patent is extended or adjusted under 35 U.S.C. 154(b) by 381 days.

(21) Appl. No.: 10/492,686

(22) PCT Filed: Sep. 25, 2002

(86) PCT No.: PCT/NO02/00340

§ 371 (c)(1),
(2), (4) Date: Aug. 30, 2004

(87) PCT Pub. No.: WO03/033985

PCT Pub. Date: Apr. 24, 2003

(65) Prior Publication Data

US 2004/0261379 A1 Dec. 30, 2004

(30) Foreign Application Priority Data

Oct. 19, 2001 (NO) ..... 20015134

(51) Int. Cl.
*F28F 9/02* (2006.01)
*F28F 21/04* (2006.01)

(52) U.S. Cl. ..... 95/43; 55/418; 96/4; 165/DIG. 395; 165/165; 422/198

(58) Field of Classification Search ..... 55/418, 55/523; 96/4, 7; 95/43; 165/143, 164, 165, 165/DIG. 395; 422/198, 220, 222
See application file for complete search history.

(56) References Cited

U.S. PATENT DOCUMENTS 3,903,694 A * 9/1975 Aine ..... 60/274

(Continued)

FOREIGN PATENT DOCUMENTS

DE 196 53 989 6/1998

(Continued)

*Primary Examiner*—Frank M. Lawrence
(74) *Attorney, Agent, or Firm*—Wenderoth, Lind & Ponack, L.L.P.

(57) ABSTRACT

A method with associated equipment for feeding two gases into and out of a multi-channel monolithic structure. The two gases will normally be gases with different chemical and/or physical properties. The first gas and the second gas are fed by means of a manifold head into channels for the first and second gases, respectively. The gases are distributed in the monolith in such a way that at least one of the channel walls is a shared or joint wall for both gases. The walls that are joint walls for the two gases will then constitute a contact area between the two gases that is available for mass and/or heat exchange. This means that the gases must be fed into channels that are spread over the entire cross-sectional area of the monolith. The entire contact area or all of the monolith's channel walls are directly used for heat and/or mass transfer between the gases. This means that the channel for one gas will always have the other gas on the other side of its channel walls.

18 Claims, 16 Drawing Sheets

U.S. PATENT DOCUMENTS

| | | | | | |
|---|---|---|---|---|---|
| 4,041,591 | A | | 8/1977 | Noll et al. | |
| 4,101,287 | A | | 7/1978 | Sweed et al. | |
| 4,271,110 | A | | 6/1981 | Minjolle | |
| 4,298,059 | A | | 11/1981 | Krauth et al. | |
| 4,421,702 | A | | 12/1983 | Oda et al. | |
| 4,428,758 | A | | 1/1984 | Montierth | |
| 4,582,126 | A | * | 4/1986 | Corey | 165/82 |
| 4,601,332 | A | * | 7/1986 | Oda et al. | 165/165 |
| 5,034,023 | A | * | 7/1991 | Thompson | 205/634 |
| 5,242,016 | A | | 9/1993 | Voss et al. | |
| 5,416,057 | A | | 5/1995 | Lipp et al. | |
| 5,913,360 | A | * | 6/1999 | Stark | 165/66 |
| 5,980,838 | A | * | 11/1999 | von Hippel et al. | 422/197 |
| 6,077,436 | A | | 6/2000 | Rajnik et al. | |
| 6,182,747 | B1 | * | 2/2001 | Stark | 165/166 |
| 6,309,612 | B1 | * | 10/2001 | Balachandran et al. | 422/222 |
| 2002/0129708 | A1 | * | 9/2002 | Weiler | 96/4 |

FOREIGN PATENT DOCUMENTS

| | | |
|---|---|---|
| EP | 0 121 455 | 4/1987 |
| EP | 0 637 727 | 2/1995 |
| EP | 1 221 580 | 7/2002 |
| GB | 2 064 361 | 6/1981 |
| SE | 444 072 | 3/1986 |
| WO | 87/02125 | 4/1987 |

* cited by examiner

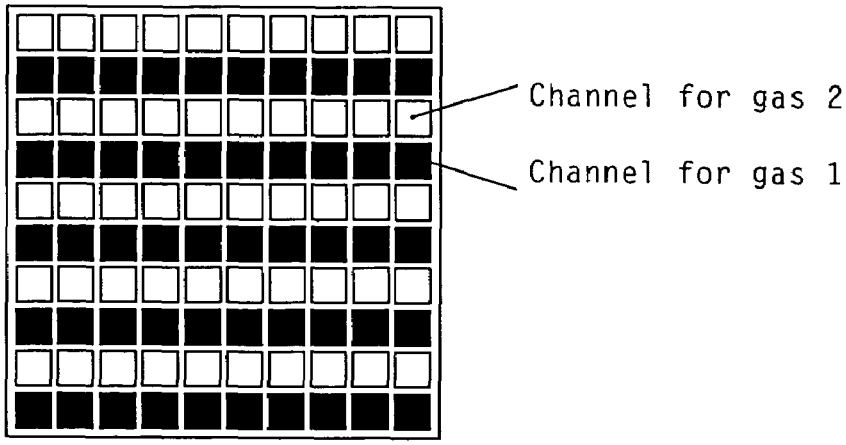
Fig. 2.1
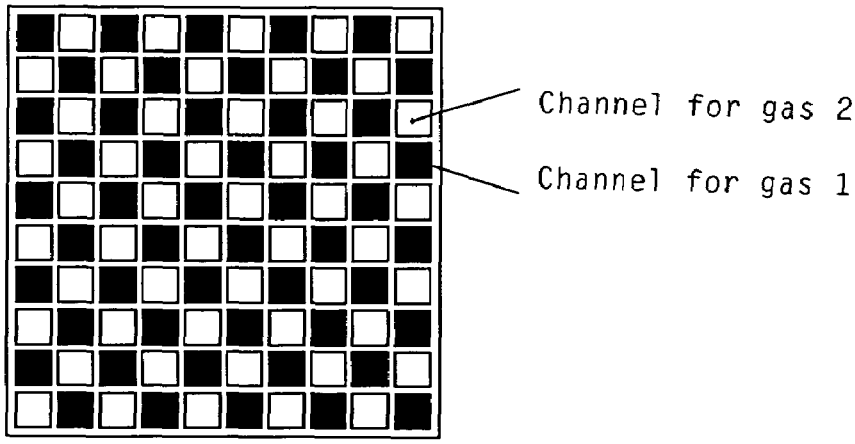
Fig. 2.2
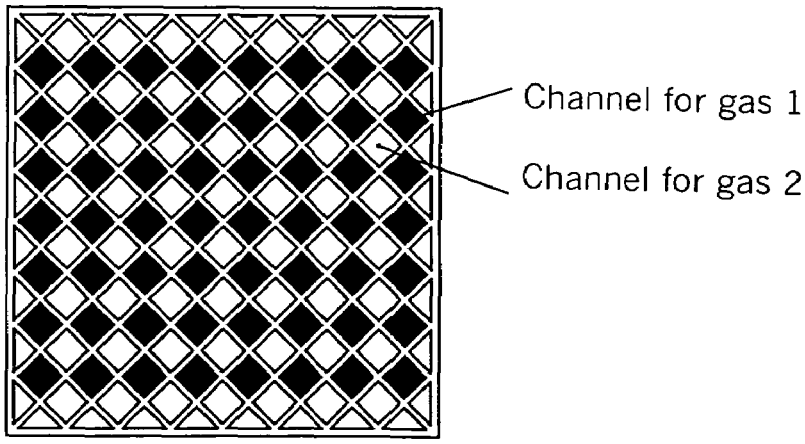
Fig. 2.3

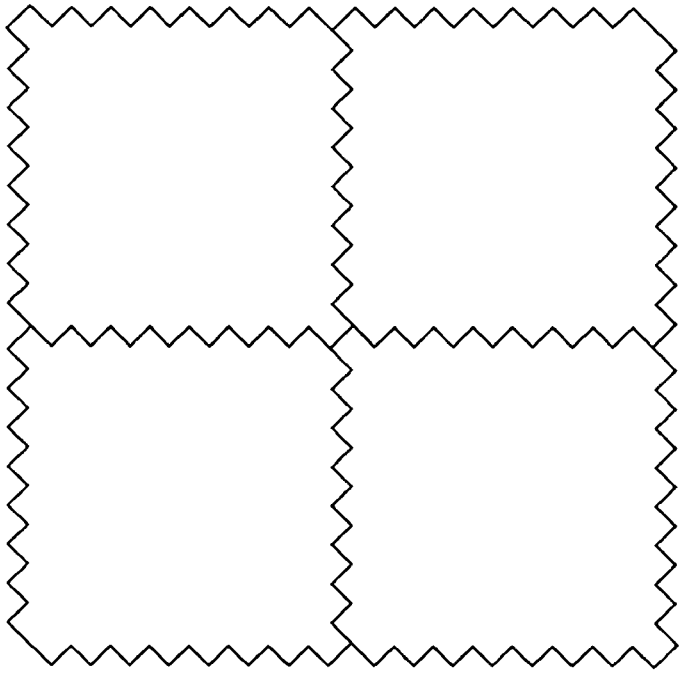
Fig. 3.2
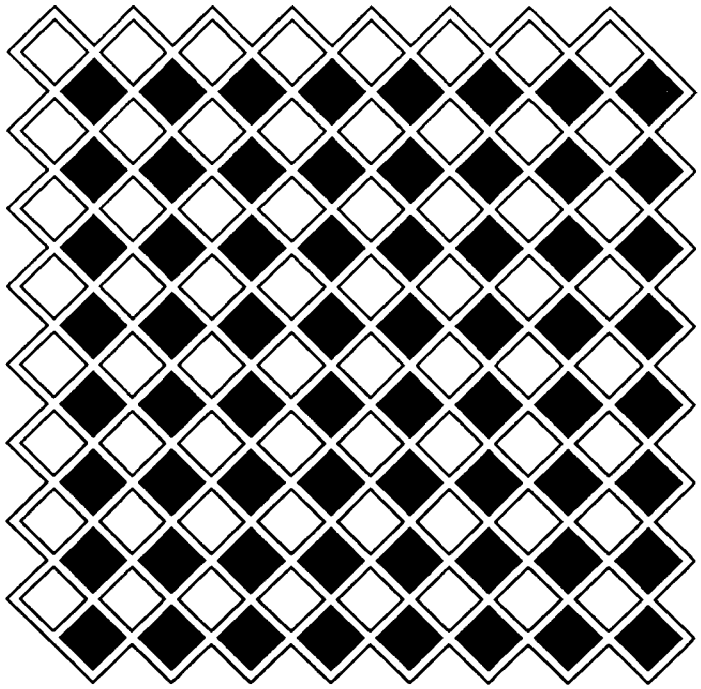
Fig. 3.1

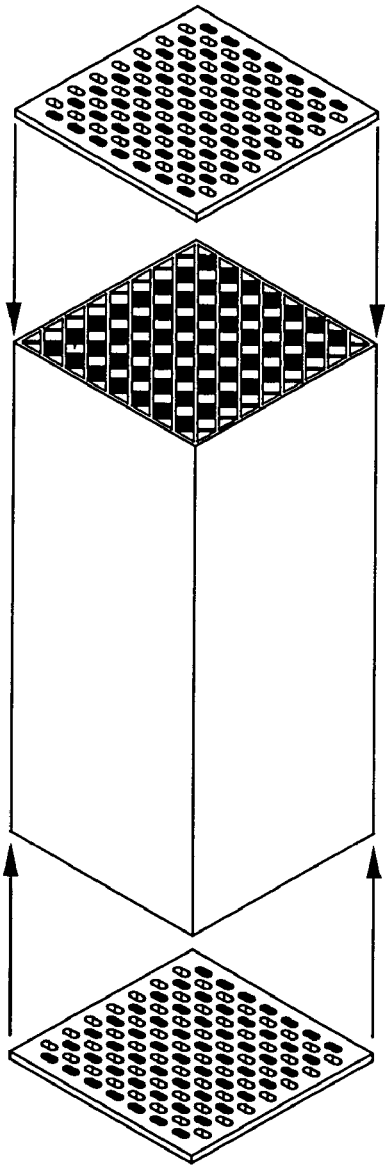
Fig.5.1
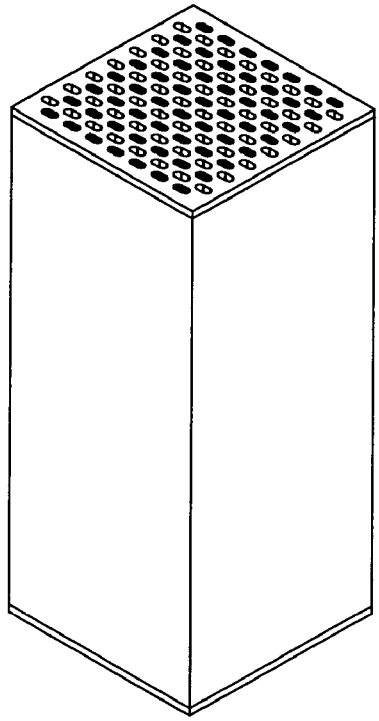
Fig.5.2

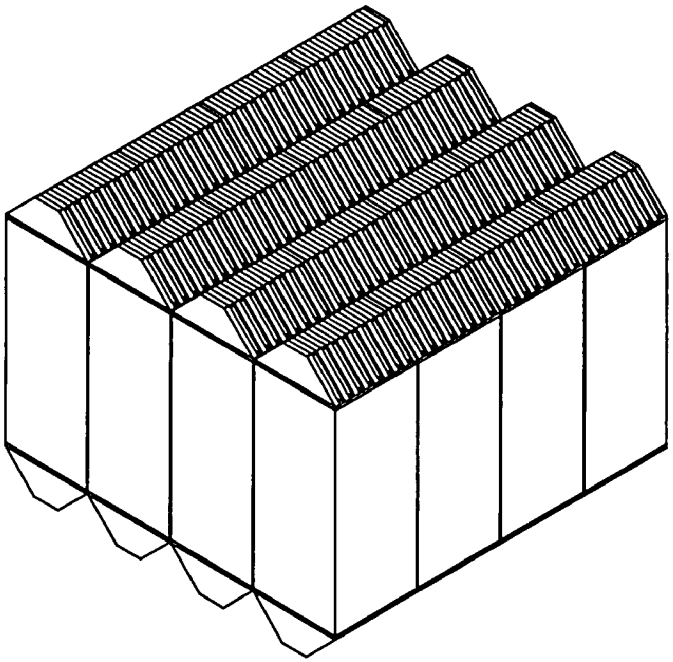
Fig. 11.2
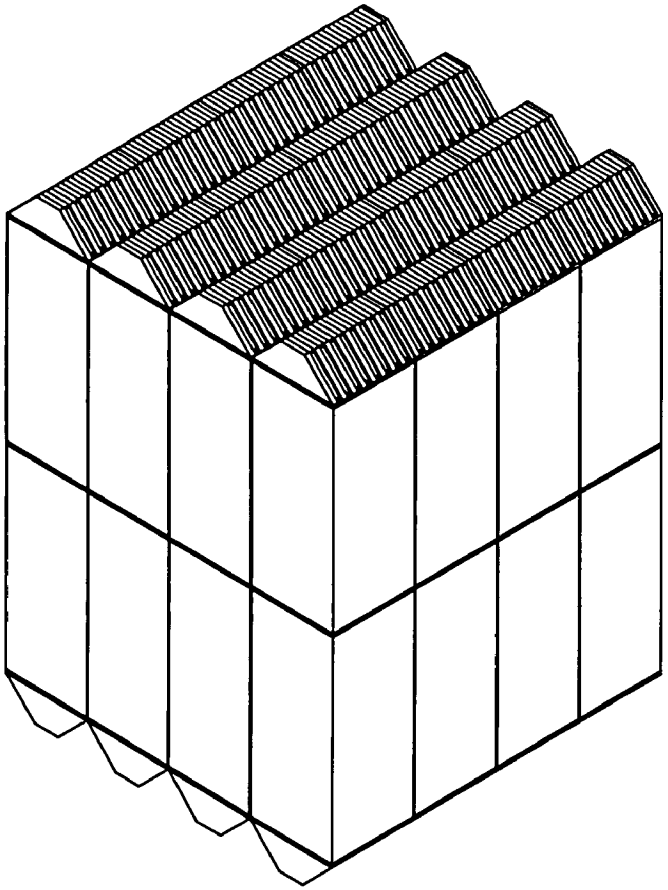
Fig. 11.1

METHOD AND EQUIPMENT FOR FEEDING TWO GASES INTO AND OUT OF A MULTI-CHANNEL MONOLITHIC STRUCTURE

BACKGROUND OF THE INVENTION

1. Field of the Invention

The present invention concerns a method with associated equipment for feeding two gases into and out of a multi-channel monolithic structure. The two gases will normally be two gases with different chemical and/or physical properties.

2. Description of Related Art

The gases, here called gas 1 and gas 2, are fed into channels for gas 1 and channels for gas 2 respectively. Gas 1 and gas 2 are distributed in the monolith in such a way that at least one of the channel walls is a shared or joint wall for gas 1 and gas 2. The walls that are joint walls for the two gases will then constitute a contact area between the two gases that is available for mass and/or heat exchange. This means that the gases must be fed into channels that are spread over the entire cross-sectional area of the monolith. The present invention makes it possible to utilize the entire contact area or all of the monolith's channel walls directly for heat and/or mass transfer between gas 1 and gas 2. This means that the channel for one gas will always have the other gas on the other side of its channel walls, i.e. all adjacent or neighbouring channels for gas 1 contain gas 2 and vice versa. The present invention is particularly applicable for making compact ceramic membrane structures and/or heat exchanger structures that must handle gases at high temperature. Typical applications are oxygen-conducting ceramic membranes, heat exchangers for gas turbines and heat exchanger reformers for production of synthetic gas.

A characteristic feature of multi-channel monolithic structures is that they consist of a body with a large number of internal longitudinal and parallel channels. The entire monolith with all its channels can be made in one operation, and the production technique used is normally extrusion. The monolith's channels are typically in the order of 1-6 mm in size, and the wall thickness is normally 0.1-1 mm. A multi-channel monolithic structure with channels of the sizes stated achieves a large surface area per volume unit. The typical values for monoliths with the channel sizes stated will be from 250 to 1000 $m^2/m^3$. Another advantage of monoliths is the straight channels, which produce low flow resistance for the gas. The monoliths are normally made of ceramic or metallic materials that tolerate high temperatures. This makes them robust and particularly applicable in high-temperature processes.

In industrial or commercial contexts, monoliths are mainly used where only one gas flows through all the channels in the monolith. The channel walls in the monolith may be coated with a catalyst that causes a chemical reaction in the gas flowing through. An example of this is monolithic structures in vehicle exhaust systems. The exhaust gas heats the walls in the monolith to a temperature that causes the catalyst to activate oxidation of undesired components in the exhaust gas.

Monolithic structures are also used to transfer heat from combustion gases or exhaust gases to incoming air for combustion processes. One method involves two gases, for example a hot and a cold gas, flowing alternately through the monolith. With such a method, for example, the exhaust gas can heat up the monolithic structure and subsequently emit heat to cold air. The air will then receive heat stored in the structure's material. When the heat is emitted from the material, the gas flow through the monolith changes back to exhaust gas, and the whole cycle is repeated. Such regenerative heat exchange processes with cycles in which there is alternation between two gases (one hot, one cold) in the same structure is not, however, suitable where mixture of the two gases is undesirable or where stable and continuous heat and/or mass exchange is desired. The industrial use of monoliths is limited mainly to applications in which only one gas flows through all the channels at the same time.

In the literature, a number of processes or applications are described in which monoliths can be used to advantage to transfer heat and/or mass between two different gas flows. Small-scale experimental tests have also been carried out with such processes. An example of this is production of synthetic gas (CO and $H_2$). Synthetic gas is normally produced using steam reformation. This is an endothermic reaction in which methane and steam react to form synthetic gas. Such a process can be carried out to advantage in a monolith in which an exothermic reaction in adjacent channels supplies heat to the steam reformation.

Although it has been shown that it will be advantageous to use monoliths for mass and/or heat exchange between two gases in a number of applications, industrial use of monoliths for such applications is not very widespread. One of the most important points of complaint or reasons why monoliths are not used in this area is that the prior art technology for feeding the two gases into and out of the monolith's separate channels is complicated and not very suitable for scaling up (i.e. interconnection of several monolith units), particularly when the large number of channels in a monolith are taken into consideration.

German patent DE 196 53 989 describes a device and a method for feeding two gases into the monolith's channels through feed pipes. These feed pipes feed the two gases into the monolith's respective channels from the plenum chambers of the respective gases. The plenum chambers are outside each other, and the pipes from the outer chamber must be fed through the inner chamber and subsequently into the monolith's channels. Each pipe must be sealed in order to prevent leakage from the channels of the monolith and from lead-throughs in the walls of the plenum chambers.

When heated, the monolith, plenum walls, pipes and sealing material will expand, and, when cooled, they will contract. This increases the likelihood of crack formation and undesired leakage with mixture of the two gases as a consequence. This likelihood will increase with the number of pipe lead-throughs.

In DE 196 53 989, the inlet and outlet zone with the sealed pipes is cooled so that a low-temperature, flexible sealing material can be used and the risk of crack formation and leakage can be reduced. A cooling system will naturally make the monolithic structure more expensive and more complicated, particularly for applications on a large scale in which the monolith consists of many thousand channels and in which it is also necessary to use many monolithic structures in series and/or in parallel to achieve a sufficient surface area.

U.S. Pat. No. 4,271,110 describes another method for feeding two gases in and out. This method has the advantage that pipe in-feeds from the plenum chamber to the channels of the respective gases in the monolithic structure can be dispensed with completely. This is achieved by cutting parallel gaps down the ends of the monolith. These cuts or gaps lead into or out of the channels for one of the gases. The gaps cut then correspond to a plenum chamber for the row of channels that the gap cuts through. By sealing the gap's opening that faces out towards the end of the monolith, openings are created in the side wall of the monolith where one of the gases can enter or leave. The other gas will then enter or leave at the short end of the monolith in the remaining open channels. The biggest disadvantage of this method, apart from the necessary processing (cutting and sealing) of the monolithic structure itself, is that only half of the available area for mass and/or heat exchange can be utilized. For example, square channels for one gas and the other gas will have to lie in connected rows so that the channel structure for the two gases corresponds to a plate heat exchanger. If the channels for the two gases were distributed as in a check pattern, where the black fields correspond to channels for one gas and the white fields correspond to channels for the other gas, the maximum utilization of the area could be achieved because, in such a gas distribution pattern, all the walls of the channels for one gas would be joint or shared walls with those of the other gas. With gas channels for the same gas in a row as in U.S. Pat. No. 4,271,110, roughly only half of the channels' walls will be in contact with those of the other gas.

SUMMARY OF THE INVENTION

By using extrusion technology for production of a monolithic structure, there is great opportunity to influence the geometric shape of the channels. Extrusion as a production method means that the entire monolithic structure is made in one operation. The channels' cross-sectional area may differ in both shape and size. The channels' cross-sectional area can be made uniform in size and shape, which is most common, for example triangular, square or hexagonal. However, combinations of several geometric shapes are also conceivable. The geometric shape, together with the size of the channel, will be significant for the mechanical strength and available surface area per volume unit.

The main object of the present invention was to arrive at a method and equipment for feeding two gases into and out of a multi-channel monolithic structure in which maximum area utilization is achieved.

If the present invention is used, it is not necessary to have cuts as described in U.S. Pat. No. 4,271,110 or pipe in-feeds as described in DE 19653989 C2.

The scope of the invention in its widest sense is a manifold head for feeding two gases into and/or out of channels in a monolithic structure, where one or more of said channels communicate with one or more plenum gaps in said manifold head.

Furthermore, it is a monolith system for mass and/or heat transfer between two gases, said system comprising a monolithic structure with internal channels and a manifold head where said manifold head is sealed to at least one end of said monolithic structure and a method for mass and/or heat transfer between two gases where said two gases are fed through one or more monolith systems.

The present invention can be integrated in a chemical plant.

The present invention grants users the freedom to use all types of shape and size and the opportunity to utilize the maximum available surface area for heat and/or mass exchange. The method described in U.S. Pat. No. 4,271,110 requires that all channels with the same gas share at least one wall so that when the shared wall is removed or machined away, a connecting gap will be created that will constitute a joint plenum chamber for the gas. The fact that two neighboring channels with the same gas must have at least one joint channel wall means that the available heat and/or mass exchange area is reduced. In DE 19653989 C2, pipes are used that are fed from the plenum chambers of the respective gases into the monolith channels, which can be distributed in such a way that the maximum available area can be utilized, i.e. the gases are fed in distributed in such a way that one gas always shares or has joint channel walls with the other gas. The two gases are distributed in the channels corresponding to a check pattern. This produces maximum utilization of the available mass and/or heat exchange area.

The present invention consists of a method and equipment that can, in an efficient manner, feed two different gases into and out of their respective channels in a multi-channel monolithic structure. It is necessary for the channel openings for the two gases to be evenly distributed or spread over the entire cross-sectional area of the monolith and for the channels to have joint walls. The equipment will, in an efficient, simple manner, collect the same type of gas, for example gas 1, from all channels containing this gas in one or more plenum chambers so that gas 1 can be kept separate from gas 2 and vice versa.

Moreover, the fewest possible number of parts or components and the least possible processing and adaptation of these parts or components and the monolith will be favorable with regard to robustness, complexity and cost. In principle, it is true to say that the fewer individual components or parts, the greater the advantage achieved. This contributes to simplifying the sealing between the two gases that are to be fed into and out of the monolith's channels. It will also be very advantageous for the equipment for feeding the two gases into and out of their respective channels in the monolithic structure to be prefabricated and sealed to the monolith itself in one or just a few operations.

Moreover, it may be favorable to achieve the largest possible contact area in a monolith with a given channel size. This will be particularly advantageous if the monolithic structure or channel walls are used as a membrane, for example a ceramic hydrogen membrane or an oxygen membrane.

To achieve the largest possible transport capacity of the relevant gas component per volume unit of the monolithic structure, it will be important to have the largest possible contact area per volume unit. It is therefore desirable for the gas that flows in one channel to have the other gas on all side walls that make up the channel. Using square channels as an example, the two gases must flow through the monolith in a channel pattern corresponding to a chess board, i.e. one gas in "white" channels and the other gas in "black" channels. In addition to being very significant for mass transfer between two gases, the largest possible direct contact area will also be important for heat transfer efficiency.

The smaller the channels are, the larger the specific surface area in the monolith will be. To achieve compact solutions, it will therefore be desirable to have the channels be as small as practically possible.

At the ends of the monolith, where the monolith's channels have their inlets and outlets, a manifold head is sealed over the monolith's channel openings. For some applications, it may be necessary to seal just one end of the monolith with a manifold head. The manifold head comprises dividing plates fitted at a distance adapted to the channel size in the monolith. The distance or space between the plates collects gas from the channels that lie in the same row. This space is called the plenum gap. The rows of channels preferably run transversely over the entire short end of the monolith and comprise either inlet or outlet channels for the same gas. These rows of gas channels with the same gas are kept separate by the sealed dividing plates in the manifold head. The two gases will then be collected in their respective plenum gaps. With rows of channels for the same gas, the plenum gap for one gas will have the plenum gap for the other gas on the other side of the dividing plate. In a monolith with square channels in which the same gas is arranged in rows, the dividing plates will have to be sealed to the channel walls in the monolith. Instead of sealing the dividing plates directly to the channel walls in the monolith, one plate may alternatively first be sealed to the short end of the monolith. This will be a plate with holes (hole plate) through which the channel openings in the monolith lead out, i.e. so that gas from the various channels that contain the same gas can be fed out through the plate's openings and into the plenum gaps. This means that the dividing plates in the manifold head are sealed to the hole plate between the rows of holes instead of directly to the monolith's channel walls that separate the two gases.

By sealing one hole plate to the end of the monolith with openings adapted for gas 1 and gas 2, the manifold head described can be used where the gas channels for gas 1 and gas 2 are distributed in a check pattern in the monolith. This represents a method and equipment for feeding two separate gases in and out that enable maximum utilization of the surface area in the monolith. The gases will be transferred from a check distribution pattern in the monolith to rows of holes in the plate sealed to the monolith. Moreover, gas 1 and gas 2 will be fed from these rows of holes out of or into the monolith's channels where gas 1 and gas 2 are distributed as in a check pattern with one gas in the "black" channels and the other gas in the "white" channels. The hole plate allows gas distributed in a check pattern to be fed out into plenum gaps divided by dividing plates that can separate gas 1 and gas 2 from each other. The plate's holes must have a slightly smaller opening area than the channel openings to which they are sealed. In addition to a reduced outlet area in relation to the channel area, the openings in the plate that is sealed to the monolith's channel structure and the dividing plates in the manifold head must also be designed and located so that the distance between the holes that lead into or out of the two gases' channels is such that it is possible to place the dividing plates between the rows of holes with inlets and/or outlets for the same gas. Using the example of square channels in which the two gases are distributed as in a check pattern, the dividing plates between the two gases will follow the straight diagonal line between rows of holes with the same gas, i.e. the square channel openings for the same gas have a joint contact point in the corners.

It is now possible to feed two gases distributed in channels in a monolithic structure out of or into separate plenum gaps. In order to be able to keep the two gases separate when they enter or leave the plenum gaps in the manifold head, the same gas can be fed to openings in the plenum gaps in a side edge of the manifold head, and, correspondingly, all plenum gaps for the other gas are led out on the opposite side edge of the manifold head to the first gas.

In a system in which there is not one single hole plate that feeds the gas from each channel through the holes in the plate and directly out into the manifold head's plenum gaps (the space between the dividing plates in the manifold head), but a system of several plates, possibly a thicker plate with diagonal through channels, the distance between the dividing plates in the manifold head can be made far larger than the channel openings in the monolith.

This is done by feeding the gas from one channel over into the flow from the neighboring channel through diagonal channels created inside the hole plate system between the monolith and the manifold head. Gas from one or more neighboring channels in the monolith must then be fed out through a joint outlet to the plenum gaps in the manifold head. These joint outlets/inlets are arranged in a system so that outlets for the same gas are gathered together and, correspondingly, the outlets for the other gas are also gathered together. These collections of outlets for the same gas are gathered together so that they create a pattern that causes the dividing plates in the manifold head to have a much greater distance from each other than if the plates were sealed directly to the manifold head, where the sides of the individual channels in the monolith would determine the distance.

The most efficient heat transfer per volume unit of monolithic structure is achieved with small channels and gas distribution in a check pattern. This can utilize almost 100% of the available surface area in the monolith. The smaller the channels, the more specific the surface area per volume unit, but small channels will also make it more complicated to feed the gases out/in through the manifold head to or from the monolith's channels. A hole plate system as described above will simplify the feeding into and out of the small channels and will allow gas distribution in a check pattern to be retained.

In the following, a method is described that will also make it easier to feed two different gases into and out of small channels. This is achieved by arranging cold and hot gas channels so that the effect of radiation can be utilized. This is done by fitting walls in the monolithic structure inside or between the channels for the cold gas that can receive radiation from the hotter gas channels. Such a distribution of the gas channels in the monolithic structure will be most relevant where the monolith is used as a heat exchanger, preferably at high gas temperatures, which produce the most efficient radiation contribution. Although such a gas distribution pattern will not be able to distribute the two gases in a pure check pattern, it will still be possible to achieve heat exchanger efficiency that is very close to that which can be achieved with gas distribution in a check pattern. Distribution of the gas channels in the monolithic structure as described above that utilizes the effect of radiation will make it possible to arrange the dividing plates in the manifold head at a greater distance from each other than the size of the cross-section of the channels. At the same time, such a system will achieve a heat transfer effect closer to that which can be achieved with gas distribution with channels of the same cross-sectional size than a system with simple distribution of cold and hot gas channels (see Example 1).

As described above, the effect of radiation is utilized by the wall internally in the channels that feed cold gas being radiated from channel walls that feed the same gas on the other side. The heating of the wall internally in channels of cold gas contributes to heating of the cold gas. The cold gas therefore becomes hotter than it would have been without such a radiated wall. It is also conceivable to use such a system with more than one wall internally between cold gas channels, i.e. the wall that directly receives radiation from the wall of the hot gas channel in turn contributes to heating the next wall internally between the next colder gas channels, etc. The effect of radiation will then, of course, gradually decrease with the number of walls internally in the cold gas channels. The radiation principle can be utilized, in the same way as that described for cold gas, by inserting walls in channels that feed hot gas.

This method, which utilizes the effect of radiation via its gas distribution in the channels, can be combined to advantage with the hole plate system described above to achieve a further simplification of the manifold head, i.e. the number of dividing plates in the manifold head can be reduced and the distance between them can be increased accordingly. This will make it possible to utilize the effect of very small unit channels (<2 mm) in the monolithic structure.

In the following, a system is described for feeding two different gases into and out of the monolithic structures without the manifold head. The method is based on the gas channels with the same gas being arranged in rows in which they share joint walls. In a similar manner to that described in U.S. Pat. No. 4,271,110, these joint walls can be cut away at a certain depth of the monolith and subsequently be sealed at the end so that openings are created in the side walls of the monolith where one of the gases can be fed in or out.

However, unlike the method described in U.S. Pat. No. 4,271,110, this method is based on the gas channels in rows not only running in parallel along the side walls in one direction but a row pattern being formed in both directions (perpendicular to each other). This means that the cuts are made for these intersecting rows, and, after sealing (as described above), the result will be openings in all four side walls of the monolith and not just in two side walls, which is the case when the rows only run in parallel in one direction. This produces greater flexibility for feeding the gases into and out of the monolith. It will then be possible to arrange the gas channels in repeating units of 3×3 with one gas in the corner channels and the other gas in the two centrally intersecting rows (cross). Similarly, it will be possible to have a repeating unit of 4×4 channels in which the centrally intersecting connected rows form a cross. The six other channels are then also placed with one in each corner (the top of the cross) and two in the corresponding outer edges on each side at the bottom of the cross.

The present invention makes it possible, in a simple and efficient manner, to feed two different gases out of and into individual channels in a multi-channel monolithic structure. This is done by means of a manifold head that is sealed to the short end or the sides of the monolith where the channel openings are. The method is based on utilizing the system in the monolith where channel openings that feed the same gas are in rows when the two gases are evenly distributed. The rows of channel holes with the same gas lead to plenum gaps in the manifold head. The plenum gaps may also be arranged with openings so that the two different gases can be fed out on either side of the manifold head. This means that we can have separate gas flows out of or into the individual channels in the monolith from separate plenum chambers (i.e. the space formed between two dividing plates). This means that it is not necessary to use pipes to feed the two gases into or out of the monolith or to make cuts or gaps in the monolith itself. Moreover, it will be possible to stack several monoliths in parallel, i.e. side surface against side surface, and thus feed the gases out of and/or into an external container through channels formed by inclined walls on the manifold heads.

If the manifold head is made rectangular with straight walls in extension of the monolith's side walls, one gas can enter or leave on the straight side wall in the manifold head while the other gas leaves or enters in openings in the short end, i.e. directly in extension of the flow direction internally in the monolith.

The monoliths must be fitted at a certain distance from each other so that the gases can enter or leave the side openings. By fitting sealing plates between the monoliths so that the gases from the various inlet/outlet openings are not mixed, plenum chambers will be formed that can be used to feed the gases into or out of the individual monoliths. Similar systems can be used for the system described with cuts that will also produce openings both in the short end in extension of the flow direction and perpendicular to the flow direction in the monolith, i.e. in the side walls of the monolith.

Moreover, the present invention will make it possible, in the same way as described above, with the stated manifold heads, to distribute two gases in gas channels in a check pattern into and/or out of a multi-channel monolith, i.e. with one gas in the "black" channels and the other gas in the "white" channels.

If the manifold head is connected directly to the monolith, the distance between the dividing plates in the monolith head will have to be smaller than the channel openings in the monolith. The lower limit of the distance between the dividing plates will therefore determine how small the channels may be that are made in the monolith. A system of hole plates between the monolith and the manifold head will make it possible to feed the gases into and out of the channels in the monolith that have a size that is much smaller than the distance between the manifold head's dividing plates. In addition, this hole plate system will also make it possible to arrange the gas channels, which are distributed in a check pattern, in a pattern in which the outlet channels for the same gas are in one row.

Moreover, a hole plate system between the monolith and the manifold head will make it possible to have a greater distance between the dividing plates than the channel openings in the monolith.

A distribution of the gas channels in a check pattern produces the maximum utilization of the contact area between the two gases in the monolith. A plate that covers all the channels is sealed to the end of the monolith and to the manifold head. The plate also has a hole pattern equivalent to the channel pattern in the monolith. The channel pattern in the monolith and the hole pattern in the plate are adapted so that holes for the same gas can form rows of holes over which the plenum gaps are placed.

The present invention requires no processing of the monolith itself if the planeness at the short end meets the tolerance deviation requirements for sealing of the hole plate to the monolith's channel end. If this is not the case, the invention will be usable if the monolith's end surfaces are processed, for example surface-ground, to the tolerance deviation requirements for sealing of the hole plate to the channel end.

Through the rows of holes of one gas in the plate, the gas is fed in or out through plenum gaps in that which now constitutes a manifold head and out or in through openings in the side wall in the same manifold head. Accordingly, the other gas is fed in or out through openings on the opposite side wall of the manifold head. The two gases are thus fed out of their respective channels in the monolith in such a way that the two gases can be collected relatively easily in separate plenum gaps.

The holes plates described, which are sealed over the channel openings in the monolith, can be made of the same material as the monolith itself. This will have the advantage that they can expand and shrink to the same extent as the monolith itself in the event of temperature fluctuations. It will also be possible to use a sealing material, for example a glass seal that tolerates high temperatures. The seal should consist of a material that has coefficients of expansion that are adapted to the material in the monolith and the hole plate. It will then not be necessary to cool the seals in the inlet and outlet ends of the monolith.

This means that such a hole plate can be used to install monoliths channel end to channel end in the desired length. If the two monoliths that are to be joined together are of different materials with different coefficients of expansion, several hole plates can be placed between the monoliths. These plates consist of materials with a gradual transition to the coefficient of expansion in the material that lies closest to the monolith to which the other monolith is to be joined.

If the monolith is equipped with the manifold head described, two monoliths can also be joined by the tops of the manifold heads being placed against each other. It must be possible to use a flexible sealing material between the tight surfaces of the manifold heads that are placed against each other.

Moreover, a gas distribution pattern in the monolith channels is described that utilizes the effect of radiation to heat walls between channels with cold gas, which is then heated more efficiently. This will allow much higher heating efficiencies to be achieved than that which can be achieved without such walls internally in the cold gas.

A channel row pattern internally in the monolith is also shown that makes it possible to feed the two different gases into and out of the monoliths without the use of a manifold head through openings in all four side walls of the monolith.

BRIEF DESCRIPTION OF THE DRAWINGS

The present invention will be further explained with reference to the accompanying drawings, wherein:

FIGS. 2.1, 2.2 and 2.3 are end views of a monolith similar to that shown in FIG. 1;

FIG. 3.1 shows a monolith in which the outer walls follow the walls of the full-sized channels in the monolith, and FIG. 3.2 shows a plurality of the monoliths shown in FIG. 3.1;

FIG. 5.1 is an exploded view of a similar monolith with the same hole plate system as that shown in FIG. 4, and FIG. 5.2 is a perspective view of the monolith with the hole plate sealed to an end of the monolith;

FIG. 11.1 shows a system of joined monoliths with connected manifold heads, and FIG. 11.2 is a perspective view of a similar system but with only one monolith in height;

DETAILED DESCRIPTION OF THE INVENTION

Figure 1:
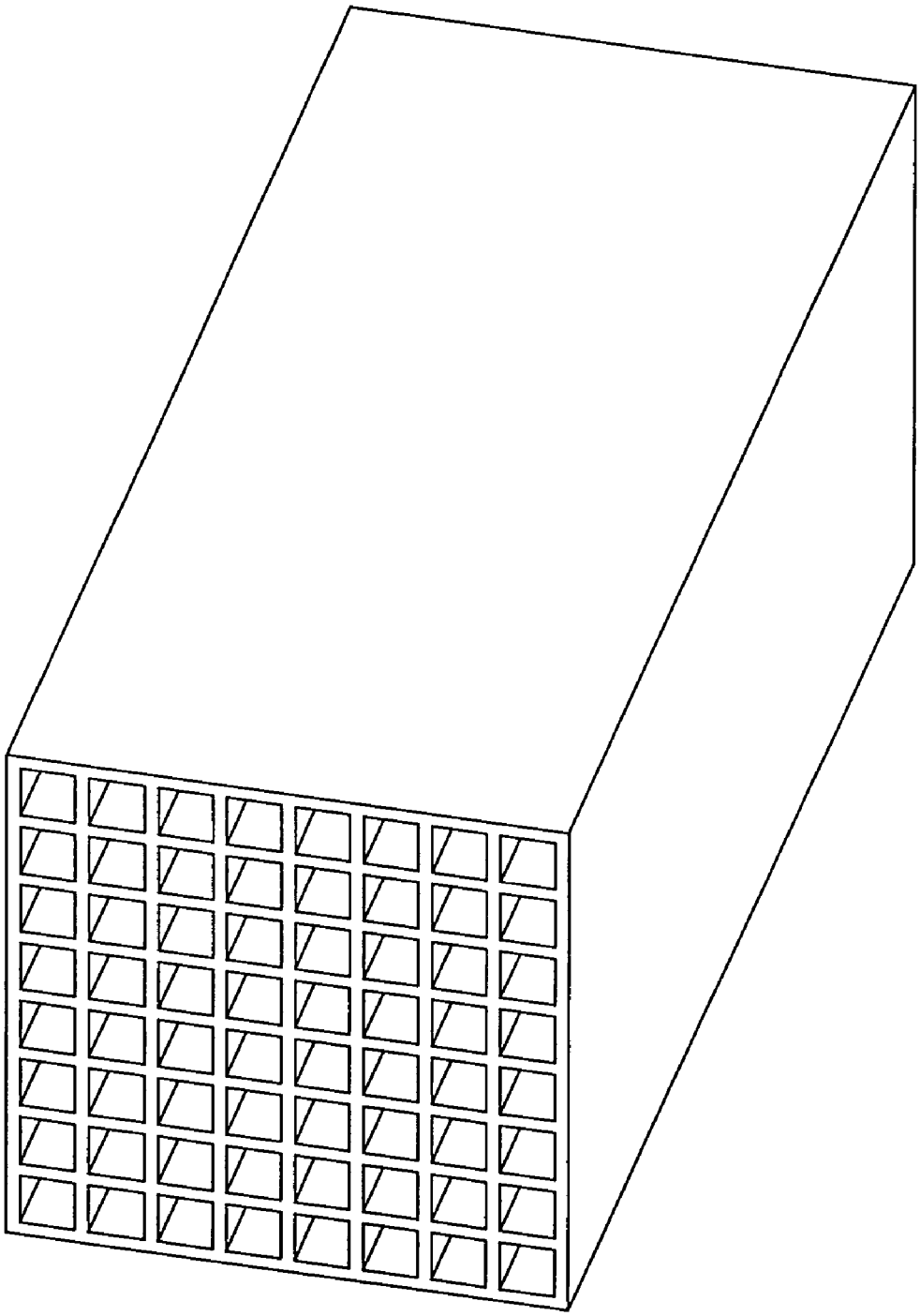
FIG. 1 is a perspective view of a multi-channel monolith with square channels.

FIG. 1 shows a perspective view of a multi-channel monolith with square channels. Such a monolith will normally be made by means of extrusion. The monolith is seen from one short end where the channels enter the monolith. The outlets of the channels will be at the other short end. The monolith's channel structure is determined by the extrusion tool. A number of different geometric shapes of channels can be made. For example, all the channels can be triangles, squares or hexagons of equal size or they can have different shapes and sizes. The channels for a monolith will normally be parallel and uniform in shape along the entire longitudinal direction of the monolith. The figure shows a monolith in which the walls of the square channels are parallel to the side walls of the monolith. This is the most common way of arranging the channels for this type of monolith.

FIGS. 2.1, 2.2 and 2.3 are front views of a monolith similar to that shown in FIG. 1, but now seen right from the front facing the short end of the monolith, i.e. only the channel openings can be seen. A gas distribution pattern is shown in the figure. The dark or shaded channels are for one gas, here indicated as gas 1, and the white channels are for the other gas, here indicated as gas 2. The gases can flow both in the same direction and in opposite directions to each other. The preferred flow pattern is normally where they flow in opposite directions.

In FIG. 2.1, the gases are distributed in continuous rows, i.e. so that the channels for the same gas have one joint wall. This makes it possible to machine away walls that have the same gas on each side at a certain depth of the monolith so that the same gas can be collected in the plenum gap formed. This is the system used in U.S. Pat. No. 4,271,110 and described in further detail there. If channels for the same gas share joint walls, there is a loss of contact area with the other gas. As FIG. 2.1 shows, when two of the walls are shared by gas channels of the same gas, the contact area between the two different gases will be roughly half of that which is theoretically possible.

FIG. 2.2 shows the same monolith as in FIG. 2.1, but here the gases are distributed in a check pattern. With such a distribution of the two gases, the available contact area in the monolith is utilized to the maximum. The channel for gas 1 has joint walls with gas 2, i.e. no joint walls with the same gas as shown in FIG. 2.1.

Like FIG. 2.2, FIG. 2.3 shows the two gases distributed in a check pattern that makes it possible to utilize the available contact area in the monolith to the maximum. The feature that distinguishes the monolith in FIG. 2.3 from the monolith in FIG. 2.2 is that the walls in the internal channels of the monolith are no longer parallel to the external walls of the monolith, but rotated 45° in relation to the side walls of the monolith. It can be seen that the lines that were diagonal in FIG. 2.2 are now arranged parallel to the side wall in the monolith in FIG. 2.3.

This means that channels with the same gas are in rows parallel to the side walls, but gases from the same channel are now only in contact in the corner points. We then achieve a similar arrangement to that in FIG. 2.1, but without the available contact area being reduced. As FIG. 2.3 shows, the channels that are in contact with the external walls of the monolith will be shaped as an isosceles triangle if the walls are straight. The walls do not necessarily have to be straight, and it is conceivable for the walls to follow the walls of the external full-sized channels. This may be advantageous when several monoliths are stacked together, and it is necessary to seal between the monolith walls. FIG. 3 shows such a system.

FIG. 3.1 shows a monolith in which the outer walls follow the walls of the full-sized channels in the monolith. Square channels arranged as shown in the figure cause the monolith's walls to assume a zigzag pattern because the square channels are in rows in parallel and along the full length of the side walls. The contact point for channels of the same gas will then be in the corners.

A monolith extruded as shown in FIG. 3.1 makes it possible to arrange several independent monoliths together as shown in FIG. 3.2. FIG. 3.2 shows an arrangement in which only the external walls of the monoliths are shown. Such a system makes it possible to utilize all the gas channels while stabilizing the monoliths or "locking" them to each other.

Figure 4:
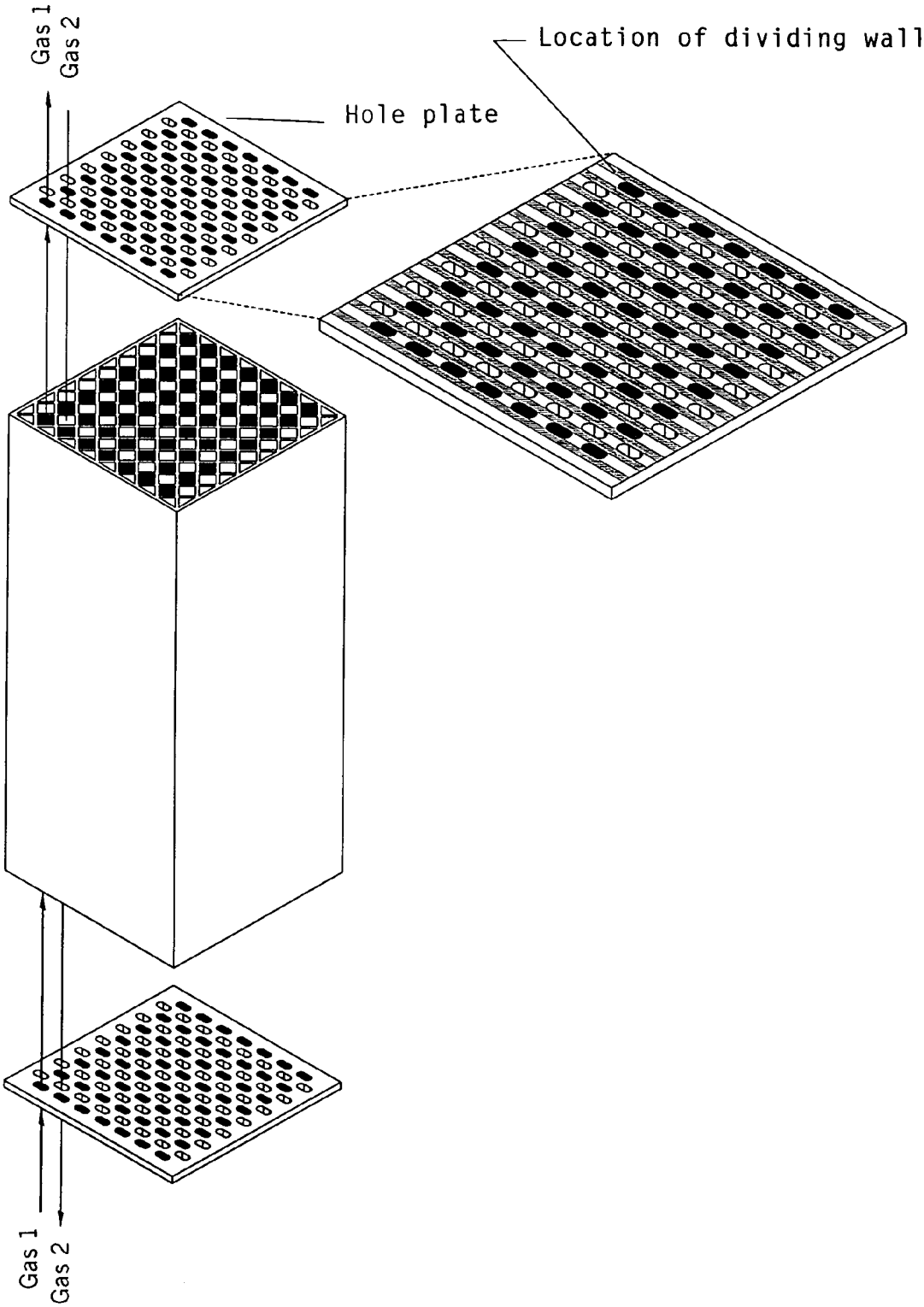
FIG. 4 is an exploded view of a monolith and distribution which is similar to those shown in FIG. 2.3.

FIG. 4 shows a similar monolith and distribution to those shown in FIG. 2.3. As in FIG. 2.3, the channels for gas 1 are dark, while the channels for gas 2 are light or white. The figure also shows two hole plates with openings that fit over the channel openings in the monolith. These hole plates are sealed to the monolith, and the two gases (here indicated as gas 1 and gas 2) will then be fed into and/or out of these holes as shown with arrows in the figure. In FIG. 4, the holes are shown with an oval shape. The holes may also be round or have a different shape.

The important factor is for the holes for the two gases to be placed in relation to each other in such a way that it is possible to place a dividing plate between the rows of holes for gas 1 and gas 2. The outer edge of the holes should lie within the limit set by the dividing wall so that leakages between the two gases do not occur.

FIG. 5 shows a similar monolith with the same hole plate system as that shown in FIG. 4. FIG. 5.1 shows the monolith with the hole plates that are to be sealed to the short end of the monolith. Openings in the plate are placed so that the gas from one channel is fed out in a certain hole, i.e. so that when the plate is sealed to the end of the monolith, all the holes are placed so that gas from the channel openings can be fed out through their respective holes. FIG. 5.2 shows the monolith with the hole plate sealed to the short end of the monolith over the channel openings.

Figures 6A, 6B:
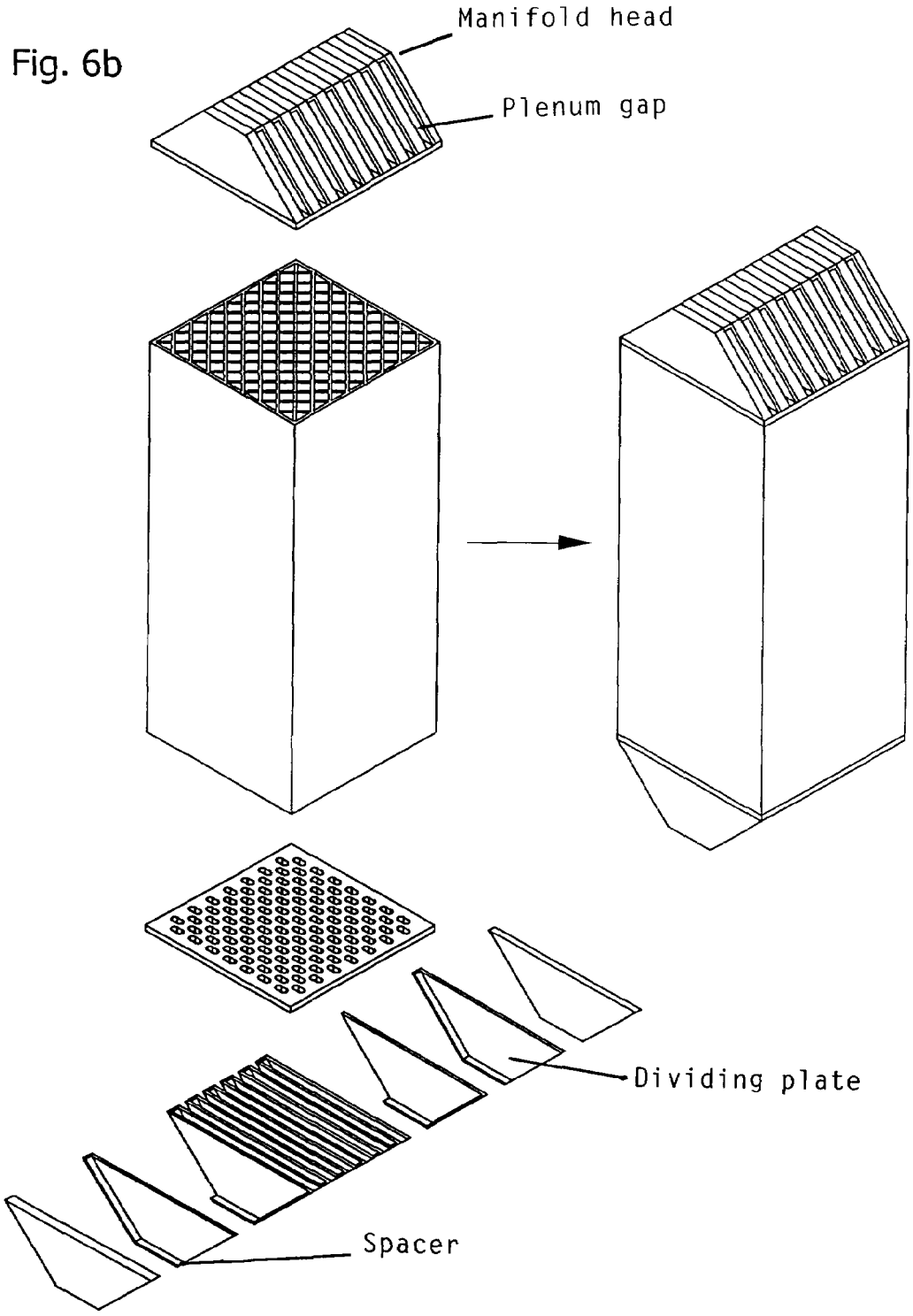
FIGS. 6*a* and 6*b* are views showing a monolith that is similar to that shown in FIG. 5.

FIGS. 6*a* and 6*b* shows a similar monolith to that in FIG. 5. In addition to the hole plate, the figure shows the shape of a manifold head that can feed gas 1 and gas 2 into or out of its respective rows of holes in the hole plate. Each row of holes (that emit or receive the same type of gas) is enclosed between two walls, and the distance between the walls is adapted to the size of the holes. This space, which is formed between the dividing plates, contains only one type of gas and is called a plenum gap. The plates can be produced individually, and two or more can be joined together as shown in FIG. 6 so that plenum gaps are formed. One or more plenum gaps put together as shown in FIG. 6*a* thus form the manifold head as shown in FIG. 6*b*.

FIG. 6*a* shows plates with spacers or edges that become external walls in the manifold head and thus enclose the plenum gaps when individual dividing plates are sealed plate to plate. FIG. 6*a* shows that one side of the plates has no edge or spacer. On every other plate, this side edge is missing on the opposite side.

When the dividing plates are sealed together, the missing side edge will produce an opening where the gas flows in or out. Gas in the adjacent plenum gap will then have its opening in the opposite side edge where the other gas flows in or out. One gas will now be fed out or in on one side, while the other gas will be fed out or in on the other side accordingly. In the manifold head, gas 1 and gas 2 will have their outlets on either side of the manifold head, see FIGS. 7 and 8.

The manifold head does not necessarily have to be made of plates that are sealed together. Other production techniques, for example extrusion, can also be used. The important thing is for the manifold head to be made so that it collects and separates the gases from the different rows of holes without the gases becoming mixed and for them to be fed out of the manifold head separately.

Figure 7:
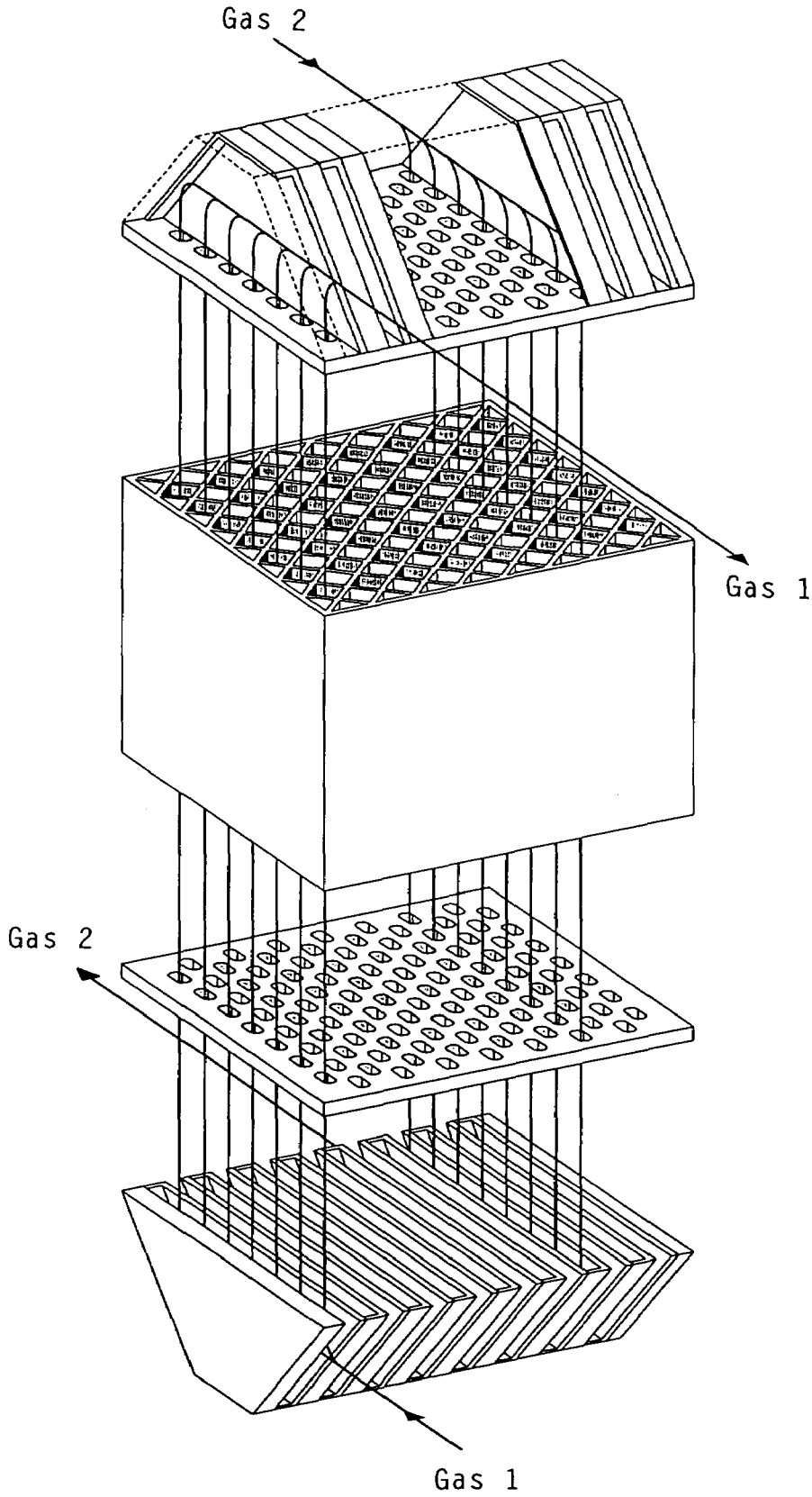
FIG. 7 is an exploded view of a monolith showing gas flows through two selected gas rows of the monolith system.

FIG. 7 shows gas through-flow in two selected gas rows through the monolith system, i.e. the monolith itself with its channels and a manifold head at each short end for feeding the two gases into and out of the monolith. In order to show the gas through-flow more clearly, the parts are lifted away from each other in the figure, and the channels for one gas (gas 1) are dark, while the channels for the other gas (gas 2) are light. The gas through-flow is shown with arrows, and the gases flow in opposite directions to each other in the figure. The figure also shows that the gases leave on the opposite side from where they enter. If one manifold head is turned the opposite way around, the inlet and outlet side for the same gas will be on the same side of the monolith.

Figure 8:
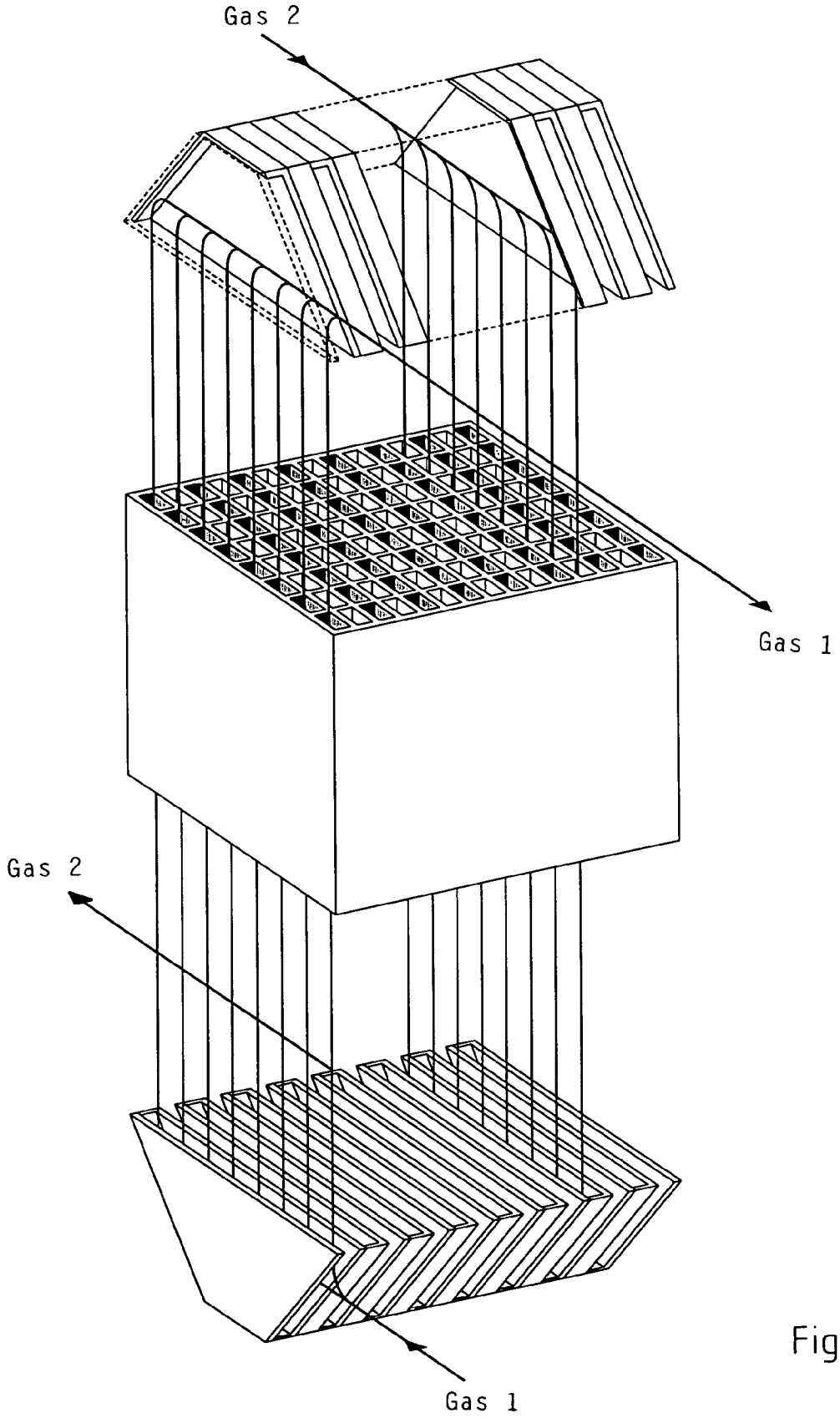
FIG. 8 shows a similar system to that in FIG. 7 except that the monolith has square channels.

FIG. 8 shows a similar system to that in FIG. 7, but FIG. 8 shows a monolith in which the square channels are arranged in rows in which the channels in the same row have common walls. If these rows of channels contain the same gas, the distribution head can be sealed directly to the channel walls without the use of a hole plate. In the figure, the distribution head is lifted away from the monolith to show more clearly how the gases flow. One gas is fed through light or white channel openings, while the other gas is fed through openings with dark or shaded channel openings. For two selected rows of channels, arrows are used to show how the two gases flow. The example shows the gases flowing in opposite directions. The disadvantage of such a gas distribution system is, as stated above, that the contact area between the two gases is halved in relation to a distribution of the gases in a check pattern. The advantage is that the pressure loss in the system is reduced when a hole plate is not used. For applications in processes in which a high pressure drop will be critical, a system such as that shown in FIG. 8 will be useful. It is also an advantage to have as few system components as possible.

Figure 9:
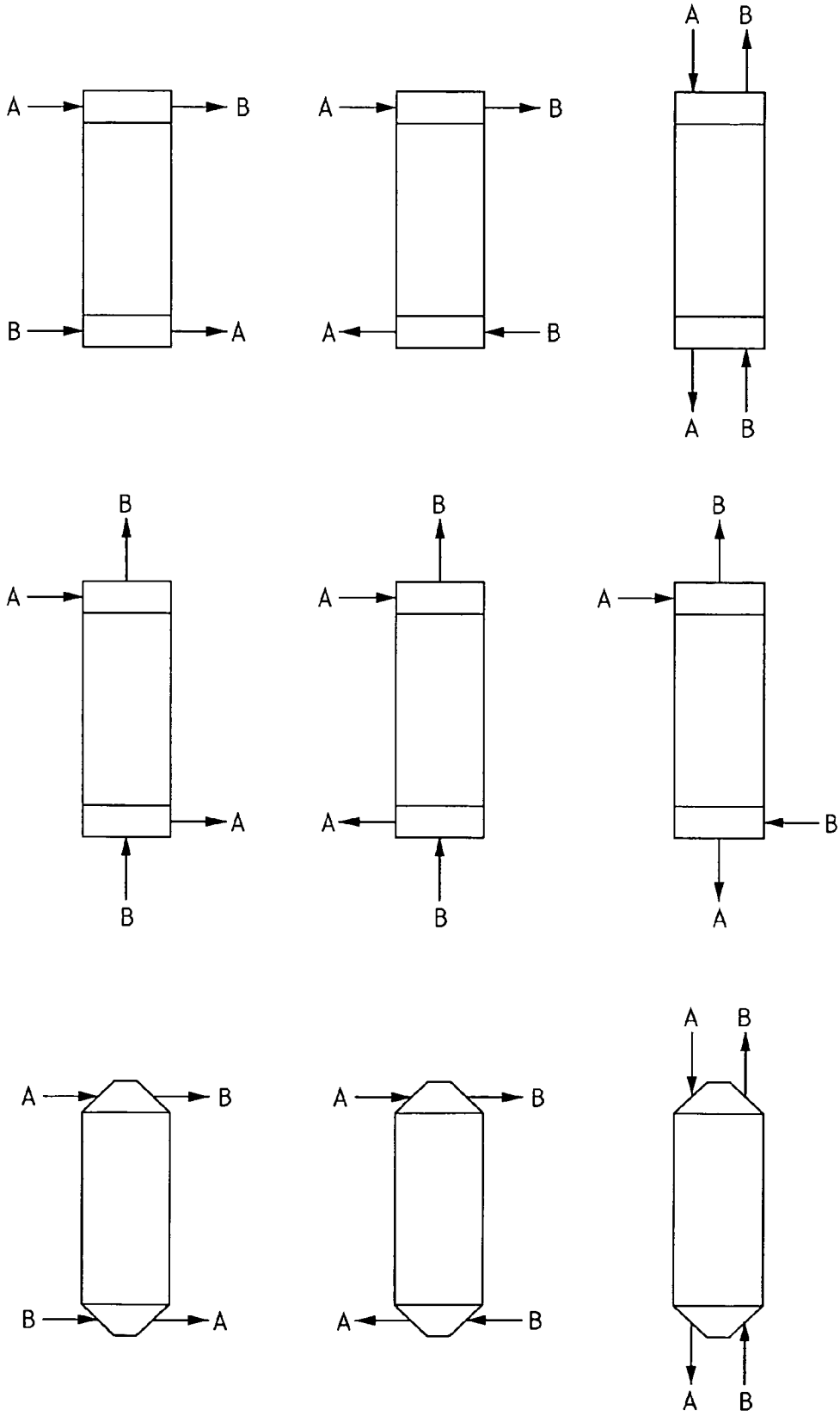
FIG. 9 shows a number of different shapes of the manifold head and various flow directions through the monoliths.

A number of different shapes of the manifold head are conceivable. The direction of flow of the gases can also vary. FIG. 9 shows two different gases flowing in opposite directions (here called A and B). However, the gases can also flow in the same direction. The side walls in the manifold head can be both parallel and diagonal to the walls of the monolith. Straight walls, as in a rectangle, will be most suitable where the gases are fed directly into or out of just one monolith. When many monoliths are to be joined, manifold heads with diagonal walls will be most suitable because longitudinal channels will then be formed between the monoliths that are stacked next to each other. The gases can be fed into or out of the monoliths through these channels.

The system offers the freedom to switch gas 1 and gas 2 at the opposite end of the monolith, i.e. gas 1 can be fed out in gaps on the opposite side wall in relation to its inlet and vice versa.

Figure 10:
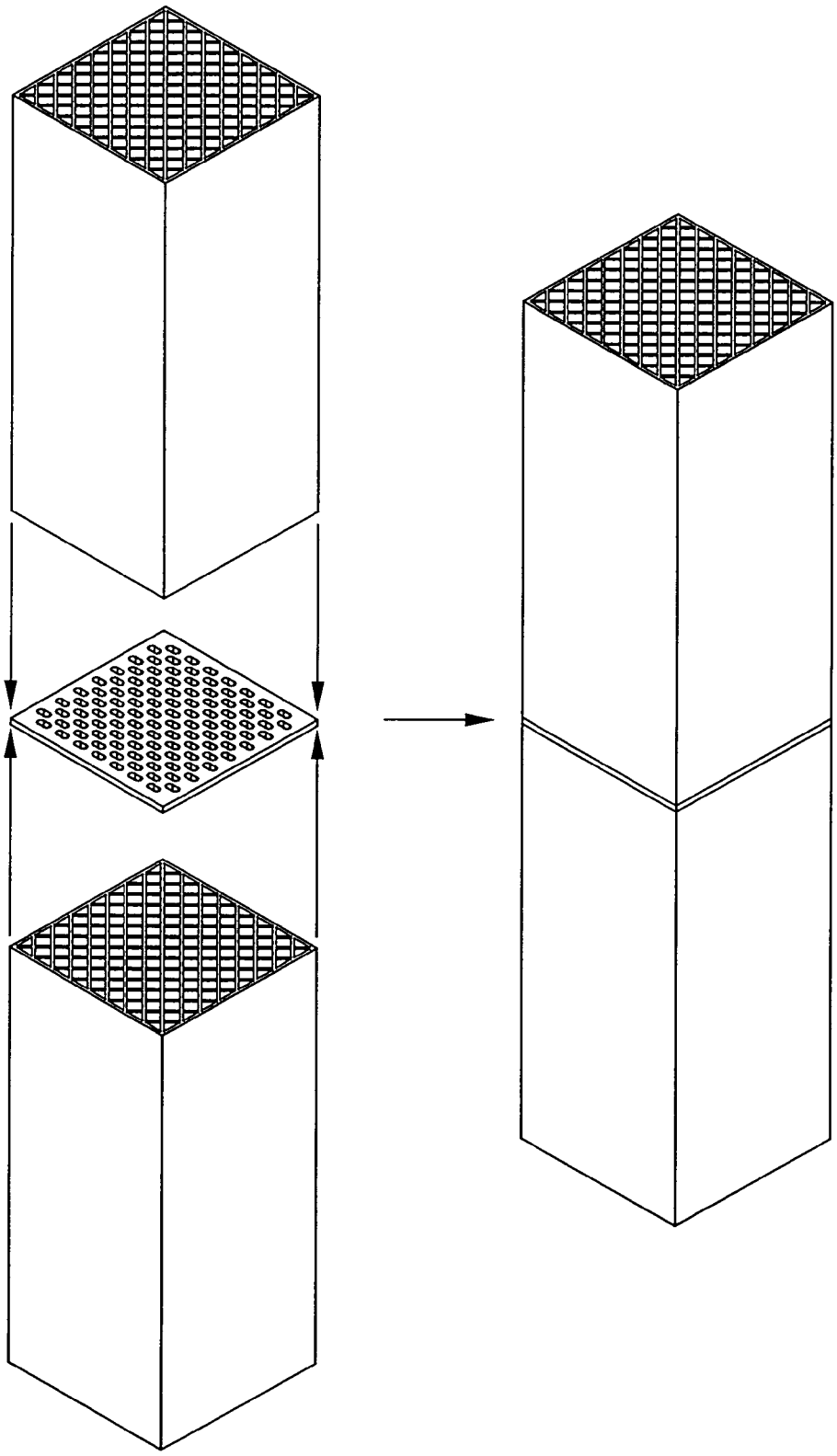
FIG. 10 shows how hole plates can be used to seal several monoliths together in a longitudinal direction of the channels.

FIG. 10 shows how hole plates can be used to seal several monoliths together in the longitudinal direction of the channels. This gives the freedom to join monoliths of the same standard size so that the total channel length can be of any length desired. In principle, the joined monoliths can then be regarded as one monolith, and plenum chambers can be mounted at each end of the joined "monolith column" in the same way as shown for one monolith in FIGS. 7 and 8.

FIG. 11.1 shows a system of joined monoliths as shown in FIG. 10, but now with manifold heads fitted. Such a system of monoliths can be placed in a closed container, for example a pressure tank. We see how a large number of monoliths can be joined together wall to wall while we retain the possibility of feeding the two gases into and out of the manifold head in the same way as for the single monolith. The manifold head described therefore offers an easy opportunity for scaling up, i.e. a system in which many single monoliths are joined together with the possibility of feeding gases into and out of all the joined monoliths. This is important in order to be able to handle large quantities of gas. FIG. 11.2 shows the same system as in FIG. 11.1, but with just one monolith in height.

Figure 12:
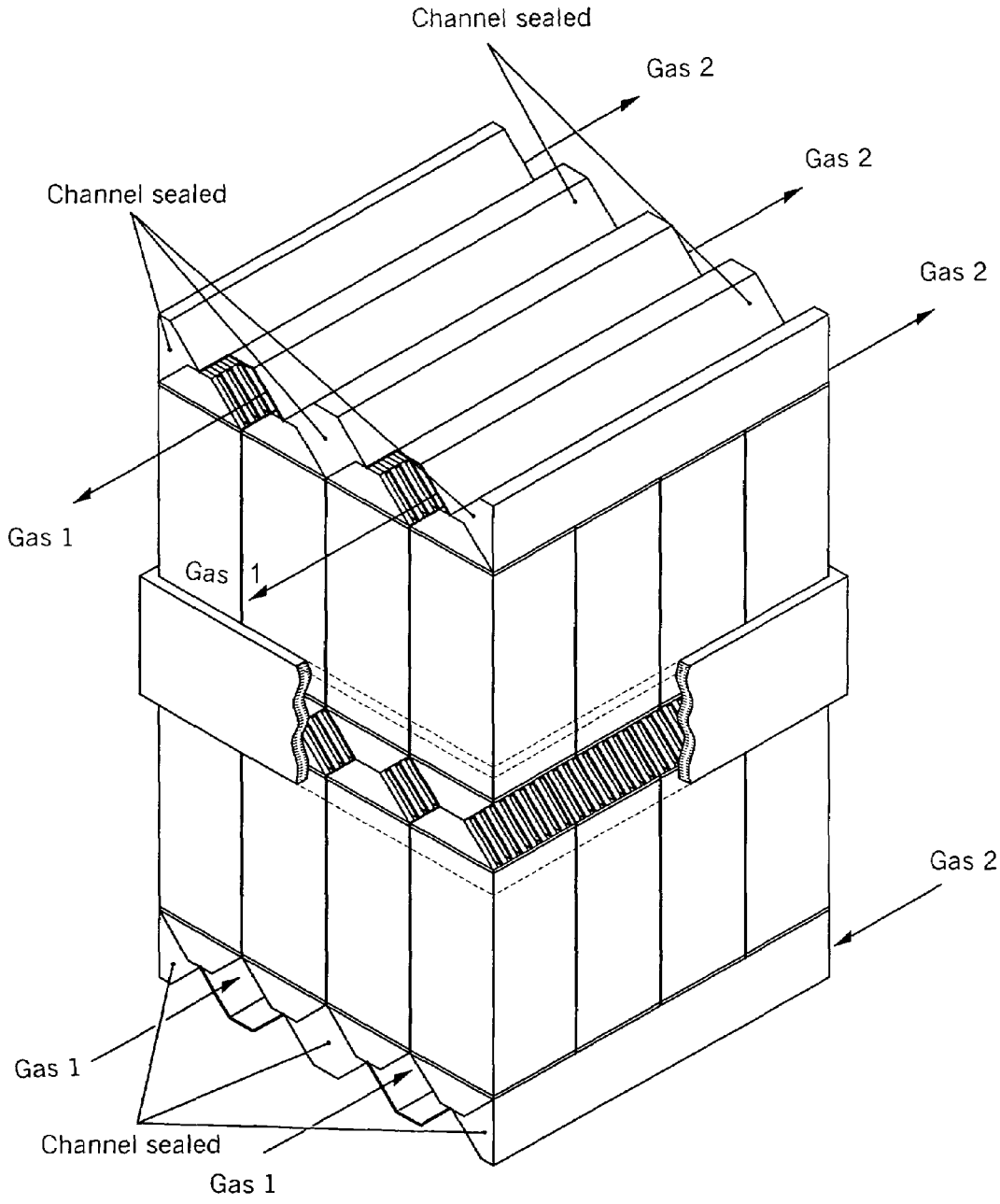
FIG. 12 shows a system of joined monoliths which is similar to that shown in FIG. 11.1 but with an alternative method of connecting the monoliths.

Like FIG. 11, FIG. 12 shows a system of joined monoliths. Here, arrows are used to show how the two gases can be fed out of the channels between the manifold heads and fed out, one on each side. In a finished system, the complete monolithic structure must be placed in a closed, insulated reactor/tank/container. This container must be equipped with an inlet and an outlet for gas 1 and a corresponding inlet and outlet for gas 2. The figure shows how the inclined walls in the manifold head form channels for the same gas when the monoliths are stacked wall to wall. Inside the container in which the complete monolithic structure is placed, for the four gas flows (inlet and outlet for each gas), there will be separate plenum gaps for the gases into and out of the container/monolithic structure.

These plenum gaps are made tight so that gas does not leak from one plenum gap to the other in the container.

The figure also shows an alternative method of joining the monoliths (in relation to that shown in FIG. 10) channel end to channel end. We see here that the monoliths are joined using the manifold heads. We see that it is the tight surface parallel to the short end of the monolith that is used. When the bottom and top of the manifold head are placed against each other as shown in the figure, this will constitute a tight surface between the two gases. It is conceivable, for example, that a flexible seal could be placed between the two surfaces. Such a joining technique will be a possibility where monoliths with different coefficients of expansion are to be joined together. The system allows monoliths of different materials to be joined, for example a ceramic membrane structure and a heat exchanger structure.

Figure 13:
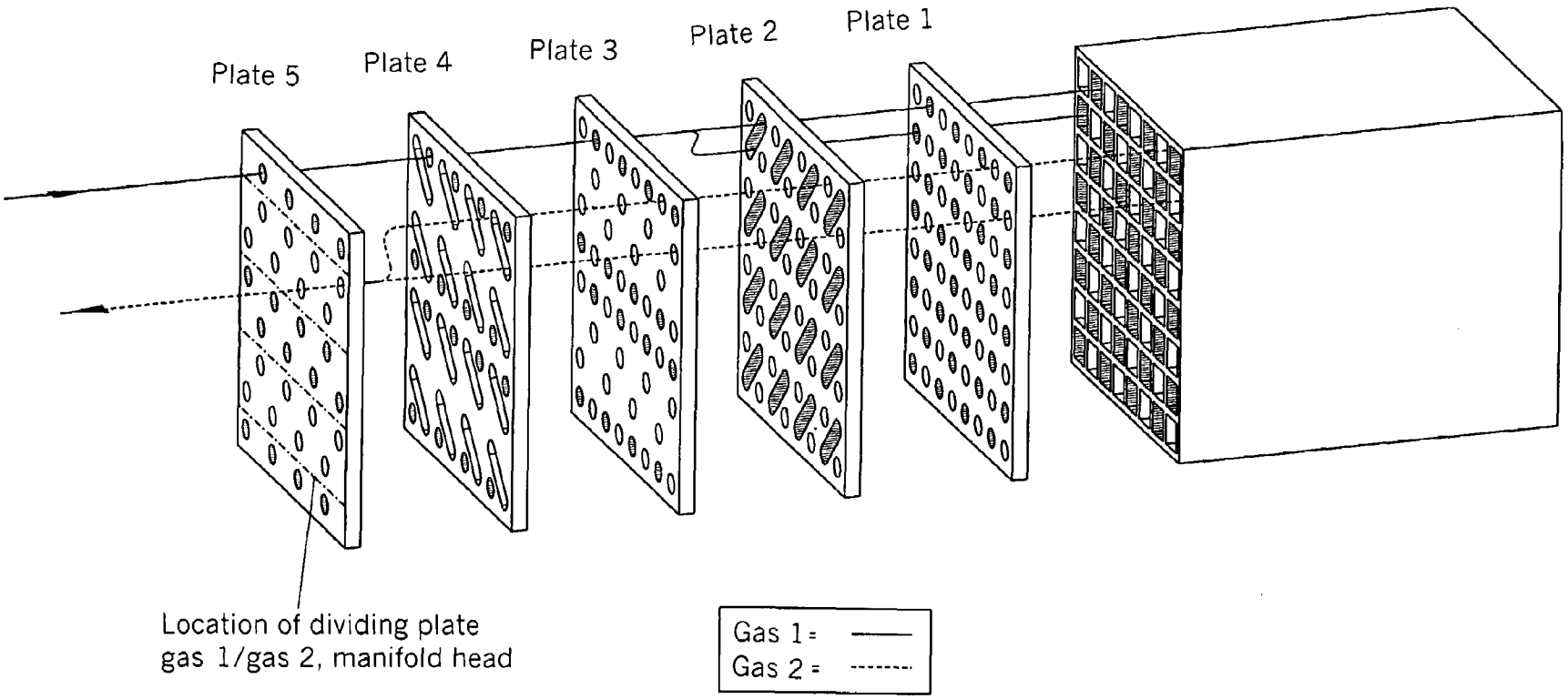
FIG. 13 is an exploded view showing how five plates between the monolith and the manifold head's dividing plates feed two gases out in separate rows so that the distance between the two gas flows increases.

The figure shows how five plates between the monolith and the manifold head's dividing plates can feed gas 1 and gas 2 out in separate rows so that the distance between the two gas flows increases. This takes place by gas from neighboring channels being fed together in a joint outlet or inlet so that the outlets or inlets for the same gas are combined. Such rows of outlets or inlets of the same gas can then be separated from each other with a manifold head with a greater distance between the dividing plates than a direct connection to the monolith. FIG. 13 shows just a small number of monolith channels. Normally, there will be a much higher number of channels in a real monolith. In the figure, the holes are shown circular. However, other hole shapes are also conceivable, for example square holes that are more adapted to the cross-sectional areas will be possible. Such holes will have a larger cross-sectional area and produce a lower pressure drop. The figure shows five plates, but it is also conceivable for plates 2 and 3 to be made as one plate, and the same applies to 4 and 5.

Figure 14:
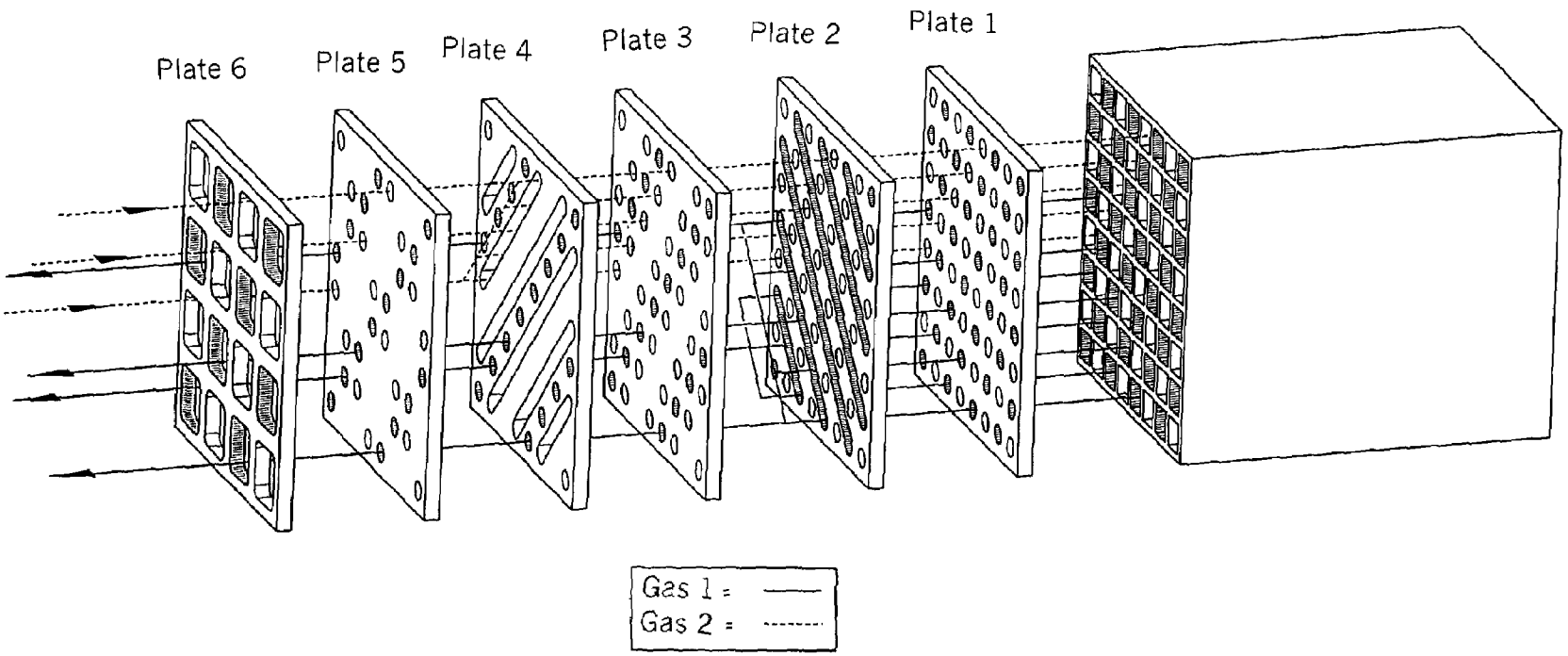
FIG. 14 is an exploded view showing how six plates between the monolith and the manifold head's dividing plates feed two gases out so as to make it possible to increase the distance between the dividing plates in the manifold head.

FIG. 14 shows how using six plates you can almost quadruple the areas of the outlet channels in a check pattern in plate 6 in relation to the individual area in the monolith. This will, in turn, make it possible to increase the distance between the dividing plates in the manifold head in relation to when they are sealed directly to the monolith. Moreover, it is conceivable for plates 2 to 5 from FIG. 13 to be placed on plate 6 so that the outlet and inlet holes are arranged in rows. This will further increase the distance between the dividing plates in the manifold head and reduce their number.

In chemical processes, the transport of components, mixing, chemical reaction, separation and heat transfer are central unit operations for which more effective solutions that may be financially advantageous are always being sought.

Figure 15:
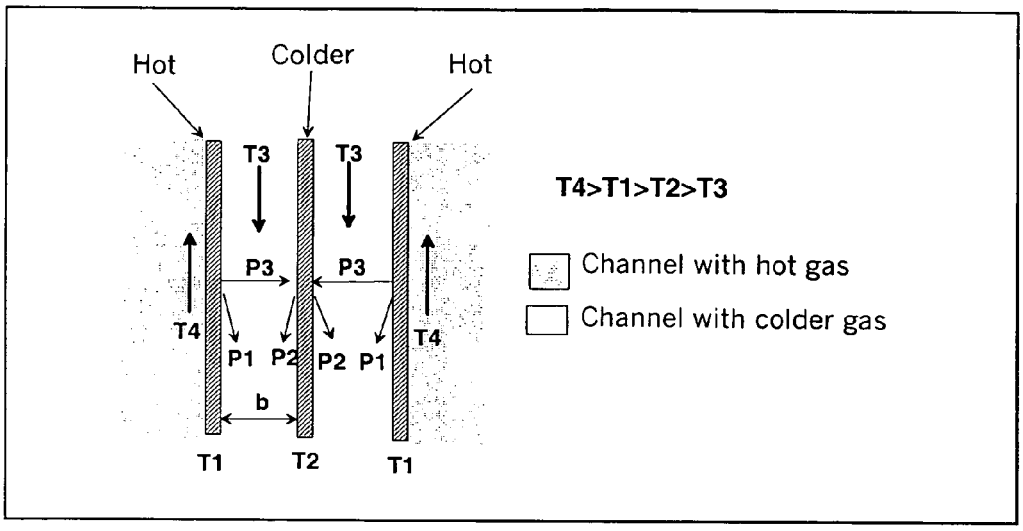
FIG. 15 is a schematic sectional view through the monolith parallel to the longitudinal direction of the channels.

FIG. 15 shows a section from the monolith parallel to the longitudinal direction of the channels. Gas flows are indicated with thick arrows. T4 indicates the temperature of hot gas, and T3 indicates the temperature of cold gas. Walls between hot and cold gas are indicated with temperature T1, while the wall between the two channels with cold gas is indicated with temperature T2. As also shown in the figure, the temperatures will be from high to low: T4>T1>T2>T3. Wall T2 will be heated via radiation (P3) from the hot wall T1, which, in turn, will be heated by the hot gas T4. Cold gas T3 will be heated both by the hot wall T1 and the heated wall T2 as indicated by the thin arrows P1 and P2.

Figure 16:
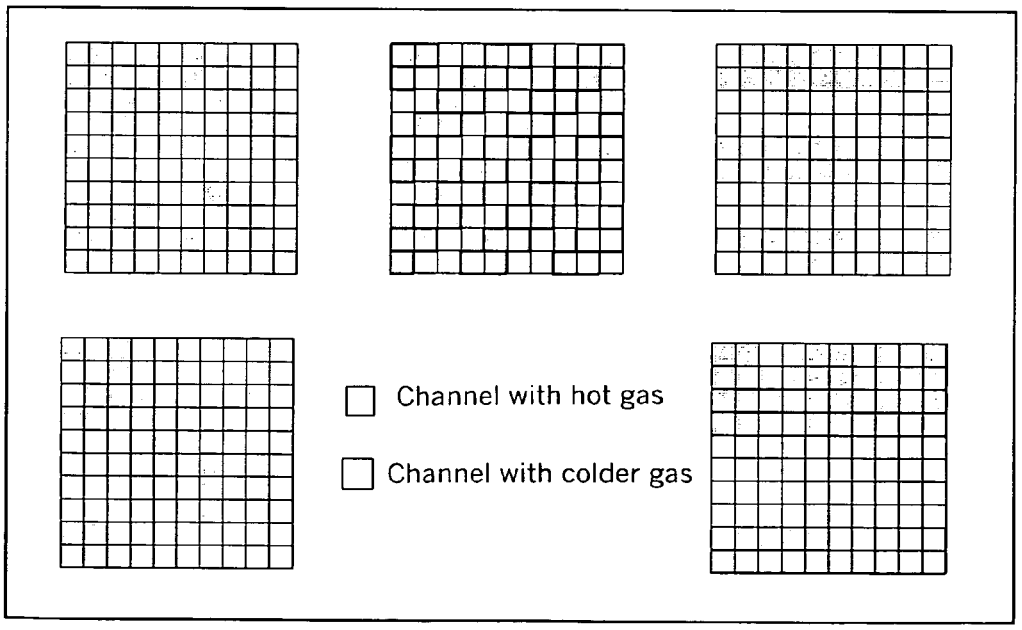
FIG. 16 shows different gas distribution patterns that utilize the radiation effect.

FIG. 16 shows different gas distribution patterns that all utilize the radiation effect where a wall that separates two channels of cold gas can be radiated by a wall that is heated by a hotter gas. As described in the text, the figure also shows possibilities of having several dividing walls internally between the cold gas channels. The radiation effect will gradually decrease but still contribute to heating that is greater than if there were no internal walls between cold gas channels.

Figure 17:
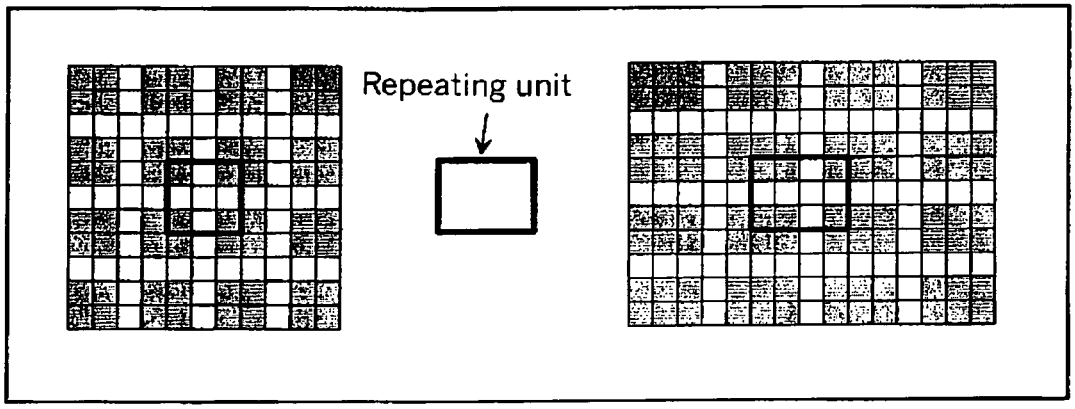
FIG. 17 shows a gas distribution arrangement in the channels that enables gas to be fed in and out internally in the monolith without a manifold head.

FIG. 17 shows a gas distribution arrangement in the channels that enables gas to be fed in and out internally in the monolith without a manifold head. As described in the text, walls between the channels with the same gas that are in rows must be cut down at a certain depth of the monolith and then be sealed at a shorter depth than they have been cut in order to form openings in the side walls of the monolith. As shown with white channels, the same gas is here in rows that intersect each other (perpendicular), and it is thus possible to form openings in all four side walls of the monolith.

EXAMPLE 1

Table 1 shows two alternatives that are calculated to show the effect of radiation when a wall internally between two colder gas channels is radiated by a hotter wall. $T_3$ and $T_4$ indicate the mean gas temperature for cold gas and hot gas respectively.

TABLE 1

Numerical values used to calculate the effect of radiation from a hot wall to a wall between two gas channels with colder gas.

| Alt. | | Hot gas in | Hot gas out | Cold gas in | Cold gas out | Hot gas mean ($T_4$) | Cold gas mean ($T_3$) |
|---|---|---|---|---|---|---|---|
| 1 | (° C.) | 1 256 | 1 050 | 1 019 | 1 221 | 1 153 | 1 120 |
| 1 | (° K.) | | | | | 1 426 | 1 393 |
| 2 | (° C.) | 1 093 | 505 | 453 | 1 000 | 799 | 727 |
| 2 | (° K.) | | | | | 1 072 | 1 000 |

A wall temperature $T_1$ is assumed midway between the hot and cold gas temperatures, and the following is produced:

| | Alt 1 | Alt 2 | |
|---|---|---|---|
| $T_1$ (° K.) | 1 410 | 1 036 | (Temperature of wall between hot and cold gas) |
| $T_2$ (° K.) | 1 393 | 1 000 | (Temperature of cold gas) |

$\lambda = 0.1$ W/mK (Thermal capacity of gas)
$b = 2.0$ mm (Distance between walls)
$\epsilon_o = 5.67\ 10^{-8}$ W/m$^2$K (Stefan Bolzmann's constant)
$\epsilon_r = 0.9$ (Emissivity of walls)
$P_1 = \lambda/b * 3.75 * (T_1 - T_3) = 3.2$ kW/m$^2$
$P_2 = \lambda/b * 3.75 * (T_2 - T_3)$
$P_3 = \epsilon_o * \epsilon_r * (T_1^4 - T_2^4)$
If $P_2 = P_3$, we get $T_2 = 1406°$ K (1133° C.) with $P_2 = P_3 = 2.4$ kW/m$^2$ for alternative 1 and $T_2 = 1019°$ K (746° C.) with $P_2 = P_3 = 3.6$ kW/m$^2$ for alternative 2

| | | Alternative 1 | Alternative 2 |
|---|---|---|---|
| With direct cold/hot gas Dividing walls | 2 * P1 | 6.4 kW/m$^2$ | 13.6 kW/m$^2$ |
| With internal radiated walls in cold gas | P1 + P2 | 5.6 kW/m$^2$ | 10.4 kW/m$^2$ |

By extruding the monolith with 2 mm square channels and arranging the channels with the same gas in double rows, it will be possible to achieve ends equivalent to 4 mm square channels. As the example shows, 88% and 76% heat transfer efficiency is achieved internally in the monolithic structure and in the ends respectively compared with single rows of 2 mm square channels.

The example is based on walls between the channels of cold gas. The temperature gradients over the wall are ignored. Accordingly, heat exchange through radiation directly from wall to gas is also ignored. However, both these effects are of little significance.

The present invention offers possibilities for improvement and simplification of unit operations for heat and mass transfer (separation) by utilizing the monolithic structures' compactness (i.e. large surface area per volume unit with small channels), low flow resistance for gases and high-temperature resistant ceramic material, which can be coated with a catalyst.

The improvements will be associated with use of the monoliths in mass and heat transfer between two different gases and the fact that these unit operations in the monolithic structure can be integrated with a chemical reaction. Such a combination of mass and heat transfer and chemical reaction (unit operations) in the monoliths will contribute to producing compact solutions in which transport and separation are simplified. One application will be a combination of endothermic and exothermic reactions, for example steam reformation of natural gas or other substances containing hydrocarbons to synthetic gas (hydrogen and carbon monoxide) with endothermic steam reformation in catalyst-coated channels and exothermic combustion in adjacent channels (gases flowing in opposite directions). Such monolithic structures can produce very compact reformers and can, for example, be used for small-scale hydrogen production. However, synthetic gas can also be processed further into a number of other products, for example methanol, ammonia and synthetic petrol/diesel.

Another example might be compact reformers used for partial oxidation of natural gas or other hydrocarbons. In this case, air or oxygen will be fed through the manifold head into the relevant outward channels in the monolith and be heated by outflowing synthetic gas in the adjacent return channels. The synthetic gas is fed out of the manifold head separated from the incoming air or oxygen. At the other end of the monolith to where the manifold head is located, there will have to be a mixing and reversing chamber in which air/oxygen is mixed with natural gas. This gas mixture flows into a catalyst-coated area of the return channels where the gas mixture reacts (partial oxidation) to form synthetic gas. The reaction generates heat and the synthetic gas in the return channels will therefore heat the air/oxygen in the outward channels (gases flowing in opposite directions).

In terms of equilibrium or thermodynamics, many chemical reactions are favored by higher temperatures than that at which the metallic material in a reactor/heat exchanger can operate (8-900° C.). In such processes, ceramic monoliths, which can both be coated with catalyst and tolerate higher temperatures, can be very advantageous. Both the steam reformation process and the partial oxidation of natural gas to form synthetic gas are examples of processes in which such high temperatures will be advantageous.

Another relevant application is in ammonia production, which includes a water gas shift reaction ($CO+H_2O \Leftrightarrow CO_2+H_2$). This reaction is used in the production of ammonia to remove CO from the synthetic gas before the ammonia synthesis itself. The reaction is slightly exothermic (−41.1 kj/kmol). This means that the equilibrium constant is reduced with the temperature, and increased reaction is thus favored by low temperatures. With adiabatic conditions in a catalyst bed, the reaction will increase the temperature and thus limit the equilibrium-related reaction rate. In today's processes, this problem is avoided by the reaction being performed in two stages, the so-called high-temperature (HT) and low-temperature (LT) shifts. Heat of reaction is removed between the HT and LT reactors so that the last stage, the LT shift, can take place at a higher reaction rate. With the monolith-based system, it will be possible to remove heat of reaction directly by having a cooling gas in channels adjacent to where the reaction is taking place (catalyst-coated). A compact reactor may thus be produced that will be able to operate under more favorable equilibrium conditions than the current two-part systems.

Ammonia could also be a relevant raw material for hydrogen production, and, for example, monolithic structures could be used for the endothermic ammonia splitting to form hydrogen. The monolithic reactor or reformer will consist alternately of catalyst-coated ammonia gas channels and a hot gas in adjacent channels that supplies energy for the ammonia splitting.

Monolithic structures could also be used on the energy market (power production), for example as heat exchangers in microturbines to make them more energy efficient. Such heat exchangers will therefore be applicable both for stationary power production and for all turbine-driven production facilities on land, at sea and in the air. They would then benefit from compact monolithic ceramic exchangers for more energy-efficient operation. The monolithic heat exchangers would transfer heat from the exhaust gas to incoming air/oxygen to the combustion chamber and thus reduce fuel consumption.

Monolithic heat exchangers could also be used in the smelting industry (aluminium, magnesium, steel, glass, etc.) to transfer heat from the furnace gas (combustion gas) to the air for the burners and thus contribute to energy saving.

Monolithic heat exchangers could also be used for the destruction of organic components, for example the destruction of dioxins that takes place at high temperatures. Gas with the undesired component is fed in its respective channels while a heat-supplying gas is fed in adjacent neighboring channels.

The invention claimed is:

1. A monolith system for mass and/or heat transfer between two gases, the system comprising:

a multi-channel monolith structure defining a plurality of channels, each of said channels having at least one joint wall for the two gases; and a manifold head sealingly connected to an end of said multi-channel monolith structure, said manifold head including a plurality of dividing plates arranged such that they form adjacent plenum gaps between adjacent ones of the dividing plates, wherein said dividing plates are connected to the channel walls in the monolith structure, wherein the distance between the dividing plates corresponds to the size of the channels in said monolith structure, wherein the channels communicate with the adjacent plenum gaps so that the two gases are kept separated by the dividing plates in said manifold head and each of the plenum gaps receives only one of the two gases.

2. The monolith system as claimed in claim 1, wherein said dividing walls are directly sealed with the channel walls of said monolith structure.

3. The monolith system as claimed in claim 1, further comprising at least one hole plate having a plurality of holes arranged in a predetermined configuration, said hole plate being located between said manifold head and said monolith structure.

4. The monolith system as claimed in claim 3, wherein the distance between said dividing plates corresponds to the size of the holes of the hole plate.

5. The monolith system as claimed in claim 3, wherein said dividing plates are sealingly connected to the hole plate.

6. The monolith system as claimed in claim 1, wherein said manifold head is sealed over only one of the ends of the monolith structure.

7. The monolith system as claimed in claim 1, wherein said at least one manifold head comprises a first manifold head sealingly connected over a first end of said monolith structure and a second manifold head sealingly connected over a second end of said monolith structure.

8. The monolith system as claimed in claim 1, wherein the dividing plates of said manifold head form openings that communicate the plenum gaps with an external side of said manifold head.

9. The monolith system as claimed in claim 8, wherein each of the dividing plates that define the openings includes side edge portions projecting toward an adjacent dividing plate except at the location of the opening.

10. The monolith system as claimed in claim 8, wherein adjacent plenum gaps communicate with the openings at opposite side of the manifold head.

11. The monolith system as claimed in claim 1, wherein one or more of the channel walls in said monolith structure are coated with one or more catalytic active components.

12. The monolith system as claimed in claim 1, wherein the channel openings for the two gases are evenly spread over the cross-sectional area defined by the monolith structure.

13. The monolith structure as claimed in claim 12, wherein the channel openings for the two gases are square and are distributed over the entire cross-sectional area on the monolith in a checkered pattern, whereby the square channel openings for the same gas have a joint contact point only at the corners thereof.

14. A method for mass and/or heat transfer between two gases, the method comprising feeding the two gases to one or more monolith systems which includes a multi-channel monolith structure defining a plurality of channels, each of said channels having at least one joint wall for the two gases;

a first manifold head sealingly connected to a first end of said multi-channel monolith structure, said first manifold head including a plurality of dividing plates arranged such that they form adjacent plenum gaps between adjacent ones of the dividing plates; and a second manifold head sealingly connected to a second end of said multi-channel monolith structure, said second manifold head including a plurality of dividing plates arranged such that they form adjacent plenum gaps between adjacent ones of the dividing plates;

wherein the dividing plates of the first and second manifold heads are connected to the channel walls in said monolith structure, wherein the distance between the dividing plates corresponds to the size of the channels in said monolith structure, wherein the channels communicate with the adjacent plenum gaps so that the two gases are kept separated by the dividing plates in said first and second manifold heads and each of the plenum gaps receives only one of the two gases.

15. The method as claimed in claim 14, wherein the two gases are fed into the first manifold head and out of the second manifold head so that the two gases flow in the same direction.

16. The method as claimed in claim 14, wherein the first of the two gases is fed into the first manifold head and out of the second manifold head, and the second of the two gases is fed into the second manifold head and out of the first manifold head so that the two gases flow in opposite directions.

17. The method as claimed in claim 14, wherein the two gases flowing from said plenum gaps are distributed into the channels of the monolith structure so that the gas flowing into one of the channels has the other gas flowing into all adjacent channels.

18. A plant for manufacturing a chemical composition including one or more monolith systems comprising:

a multi-channel monolith structure defining a plurality of channels, each of said channels having at least one joint wall for two gases; and a manifold head sealingly connected to an end of said multi-channel monolith structure, said manifold head including a plurality of dividing plates arranged such that they form adjacent plenum gaps between adjacent ones of the dividing plates, wherein said dividing plates are connected to the channel walls in the monolith structure, wherein the distance between the dividing plates corresponds to the size of the channels in said monolith structure, and wherein the channels communicate with the adjacent plenum gaps so that the two gases are kept separated from each other by the dividing plates in said manifold head and each of the plenum gaps receives only one of the two gases.

* * * * *